US005966560A

United States Patent [19]

Kodama et al.

[11] Patent Number: 5,966,560

[45] Date of Patent: Oct. 12, 1999

[54] IMAGE FORMING APPARATUS WITH ENHANCED PRETRANSFER ERASING

[75] Inventors: Hideaki Kodama, Okazaki; Yasuhiro Ohno, Amagasaki; Kazuomi Sakatani, Toyohashi; Makoto Takase, Okazaki, all of Japan

[73] Assignee: Minolta Co., Ltd., Osaka, Japan

[21] Appl. No.: 08/704,210

[22] Filed: Aug. 29, 1996

[30] Foreign Application Priority Data

| | | | |
|---|---|---|---|
| Aug. 29, 1995 | [JP] | Japan | 7-220179 |
| Oct. 5, 1995 | [JP] | Japan | 7-258573 |
| Nov. 10, 1995 | [JP] | Japan | 7-292647 |

[51] Int. Cl.[6] ..... G03G 15/14

[52] U.S. Cl. ..... 399/66; 399/318

[58] Field of Search ..... 399/44, 66, 318

[56] References Cited

U.S. PATENT DOCUMENTS

| | | | |
|---|---|---|---|
| 4,536,082 | 8/1985 | Motohashi et al. | 399/66 X |
| 5,119,141 | 6/1992 | Bhagat | 399/44 |
| 5,371,579 | 12/1994 | Bisaiji | 399/44 |
| 5,649,272 | 7/1997 | Kwon | 399/318 |

FOREIGN PATENT DOCUMENTS

| | | |
|---|---|---|
| 1-262573 | 10/1989 | Japan . |
| 2-8874 | 1/1990 | Japan . |
| 3-283767 | 12/1991 | Japan . |
| 5-003543 | 1/1993 | Japan . |
| 6-95476 | 4/1994 | Japan . |
| 6-282176 | 10/1994 | Japan . |

*Primary Examiner*—Fred L Braun
*Attorney, Agent, or Firm*—McDermott, Will & Emery

[57] ABSTRACT

In an electrophotographic copying machine, image quality is improved by suppressing phenomena such as narrowing and thickening of a linear image or discharge noises in a photograph image due to anomalies on transfer of a toner image. For example, a document type is discriminated and when a transfer brush is used for transfer, transfer current and pretransfer erasing are controlled according to the type of document image. The pretransfer erasing is controlled in various following situations: Bi-level exposure method or multi-level exposure method, edge emphasis, photoelectric efficiency, the surface potential of the photoconductor, and position of a developing device.

34 Claims, 30 Drawing Sheets

S105
Character/photograph mode

S110
Start internal timer
S111
Main erasing
S112
Sensitizing
S113
Exposure
S114
Development
S115
Read image data
S116
Character area
NO
YES
S117
Set erasing intensity for character area
S118
Set erasing intensity for photograph area
S119
Pretransfer erasing
S120
Transfer
S121
Cleaning
S122
Other processing
S123
Is the timer completed ?
NO
YES
RETURN Normal mode Sharpness mode

IMAGE FORMING APPARATUS WITH ENHANCED PRETRANSFER ERASING

BACKGROUND OF THE INVENTION

1. Field of the Invention

The present invention relates to an image forming apparatus using an electrophotographic process such as a copying machine, or in particular to image transfer onto a transfer material which affects an image quality of a hard copy.

2. Description of the Prior Art

In an electrophotographic process in an image forming apparatus such as a copying machine or a printer, a photoconductor, sensitized uniformly, is exposed according to the image data of a document, and an electrostatic latent image is formed on the photoconductor. Toners are absorbed onto the latent image by a developing device to form a visible toner image on the latent image. Then, the toner image on the surface of the photoconductor is transferred and fixed onto a transfer paper. The invention relates to the transfer of the toner image.

Such an image forming apparatus is used for reproducing various types of documents. For example, a document may include a bi-level image such as a document including characters, a document including a half-tone image such as a photograph, or a document including both characters and photographs. Then, in order to guarantee image quality for various types of documents, it is proposed, mainly in a field of a digital copying machine, to decide the attributes of a document according to the features of image data of the document, and change to image processing according to the attributes.

However, even if image processing is changed according to the attributes of image data, phenomena such as missing inside, narrowing of linear image, toner scattering, discharge noises and voids are observed. A missing inside denotes a phenomenon where a white portion with no toners happens in a black portion of a character. Narrowing denotes a phenomenon where a width of a linear image becomes narrower than the original width. Toner scattering denotes a phenomenon where toners scatter around a toner image. Discharge noises denote a phenomenon where noises happen in an area resulting in no image being reproduced in the area. A void denotes a phenomenon where a transfer of an image becomes insufficient for a dot image document or a photograph document.

In order to prevent discharge noises and toner scattering on transfer, an eraser is provided between a development position and a transfer position by exposing the entire surface of the photoconductor before transfer to remove charges on the photoconductor. This eraser is called a pretransfer eraser. Previously, an intensity of light emission of the pretransfer eraser is set at a constant value, say 5–6 $mW/cm^2$) irrespective of document type.

The appropriate intensity of the pretransfer eraser depends on the kind of document, but it also depends on other many factors such as gradation reproduction method, image density, environment (humidity or the like) or sensitivity of the photoconductor. For example, discharge noises are liable to happen at a highlight portion in an image.

Strictly speaking, an appropriate discharging of the surface of the photoconductor, that is, the intensity of light emission of the pretransfer eraser depends on the type of a document, gradation reproduction method, a document image and the like. In general, if the amount of discharging is large, toners tend to be scattered easily around a character image, while if the amount of discharging is small, discharge noises tends to occur easily. In a usual character image, toner scattering and discharge noises are noticeable. Therefore, the amount of discharging for a character image is set at a value which can prevent discharge noises and suppress toner scattering. On the other hand, in a photograph image, toner scattering is not noticeable, but discharge noises are noticeable in a highlight portion. Therefore, it is desirable that the amount of discharging is higher for a photograph image than for a character image.

When a two-component developing material is used, carriers adhere more easily to the photoconductor with an increase in difference between the potential of a non-image area of the photoconductor and the developing bias potential of the developing device. Many edges exist in a latent image formed with the bi-level exposure method. Then, even if the above-mentioned potential difference is not large, carriers are liable to adhere due to the edge effect. Then, there is a tendency that toners are not transferred easily to form an image having erroneous white portions generated by an incomplete transfer. On the other hand, in an image formed with the multi-level exposing method, such erroneous white portions are not noticeable, but toner scattering and inside vanishing become noticeable.

Sharpness mode is provided for emphasizing the density change in an image. For a map document, a line is reproduced more clearly by using the sharpness mode. When the sharpness mode is selected, phenomena such as toner scattering, narrowing or widening of a line image are liable to happen according to the difference between the potentials of image areas and non-image areas at the transfer point.

Appropriate discharging of charges on the photoconductor, that is, the intensity of light emission of the pretransfer eraser has to be changed according to environment such as humidity and temperature. In order to solve this problem, Japanese Patent laid open Publication 2-8874/1990 proposes an image forming apparatus which controls turning on/off of the pretransfer eraser according to the change in the humidity and temperature inside the apparatus. However, because the intensity of light emission of the pretransfer eraser cannot be set at an arbitrary value, it cannot be controlled precisely according to humidity and temperature. Moreover, it is also not possible to deal with a change in environment other than humidity and temperature, for example, the amount of charges on the photoconductor or sensitivity of the photoconductor.

SUMMARY OF THE INVENTION

An object of the invention is to provide an image forming apparatus which improves an image quality on a transfer material by suppressing phenomena such as narrowing, missing inside, toner scattering or voids.

A second object of the invention is to provide an image forming apparatus which can perform pretransfer erasing more appropriately or effectively.

In one aspect of the invention, in an electrophotographic image-forming apparatus, a document type such as character image, photograph image or dot image is discriminated according to the image data. Then, transfer conditions are controlled according to the document type. For example, when a transfer brush is used, transfer current and pretransfer erasing are controlled according to the document type. Further, pretransfer erasing is also controlled according to the document type to remove charges on the photoconductor. As a result, phenomena are prevented such as narrowing and thickening of a linear image or discharge noises in a photograph image due to anomalies on the transfer of a toner image.

In a different aspect of the invention, the pretransfer eraser is controlled in the following types of situations: For example, the pretransfer eraser is controlled according as gradation is expressed with bi-level exposure method or multi-level exposure method. The pretransfer eraser is also controlled whether edge emphasis is performed or not. Further, the pretransfer eraser is controlled according to photoelectric efficiency of the photoconductor or according to measurement of the potential of the photoconductor. When a plurality of developing devices are arranged around the photoconductor at different development points, the pretransfer is controlled according to a distance from the development point to the transfer point.

An advantage of the present invention is that a good image without noises can be reproduced.

BRIEF DESCRIPTION OF THE DRAWINGS

These and other objects and features of the present invention will become clear from the following description taken in conjunction with the preferred embodiments thereof with reference to the accompanying drawings, and in which.

DETAILED DESCRIPTION OF THE PREFERRED EMBODIMENTS

Figure 1:
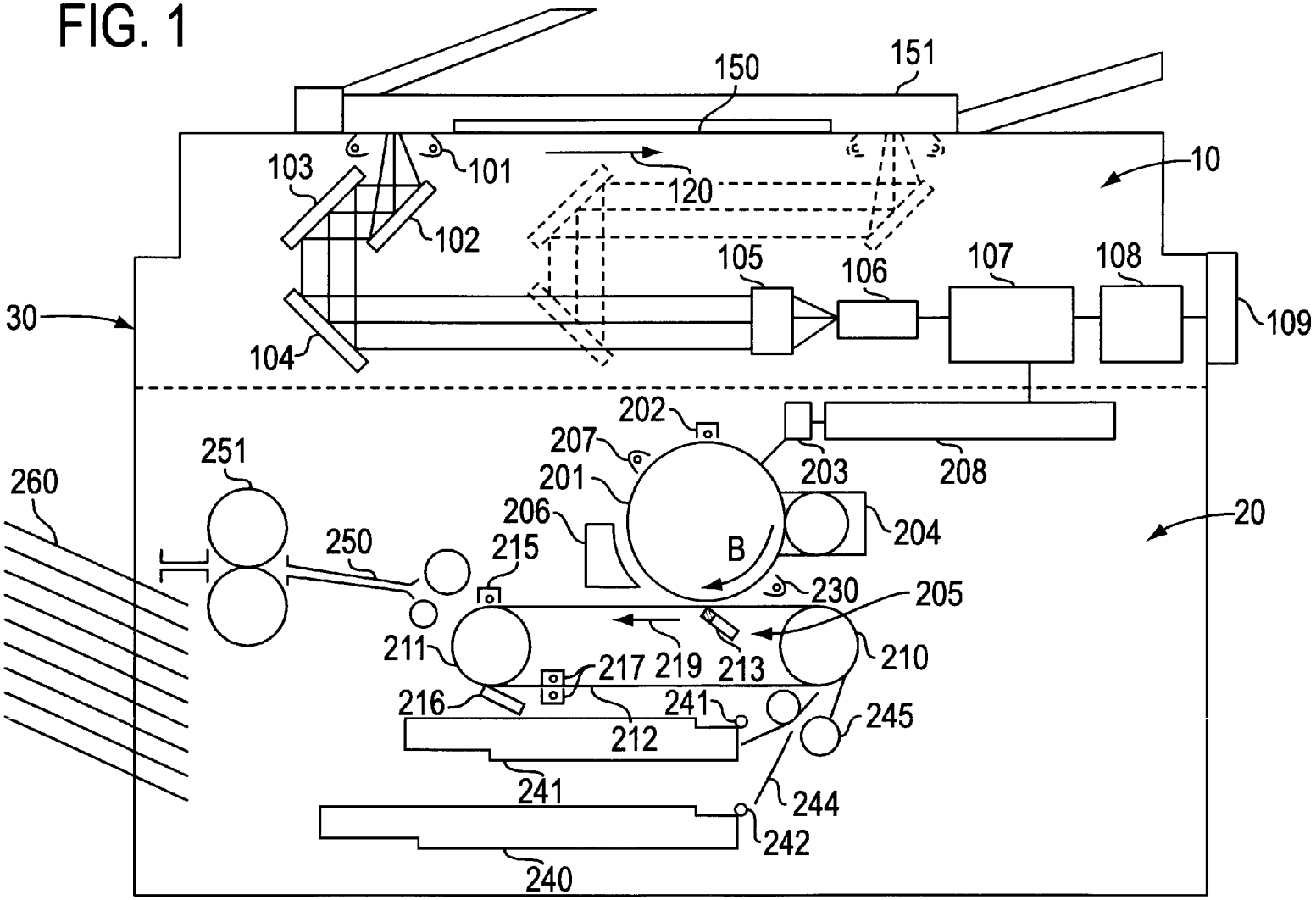
FIG. 1 is a schematic sectional view of a digital copying machine of a first embodiment.

Referring now to the drawings, wherein like reference characters designate like or corresponding parts throughout the views, FIG. 1 shows a digital copying machine of a first embodiment of the invention schematically. This copying machine has features that include a transfer belt 212 with a sensitizing brush 213 used for transfer and an eraser lamp 230 provided before the transfer point. The digital copying machine comprises an image scanner 10 at an upper portion and a printer 20 at a lower portion in a case 30. A platen glass 150 is provided at the top of the case 30. A document cover 151 including an automatic document feeder is put on the platen glass 150, and the cover can be closed or opened.

The image scanner 10 comprises a light source 101, mirrors 102–104, a focusing lens 105, a charge coupled device (CCD) 106, a read image processor 107, a frame memory 108 and an external memory 109. The light source 101 and the mirror 102 are mounted at a block. When a start switch is pressed, the light source 101 moves relative to a document put on the platen glass 150 along a subscan direction shown with an arrow 120, while illuminating the document through a slit. The mirrors 103 and 104 mounted to another block also move along the subscan direction, but at a slower speed than the light source.

The lens 105, the CCD 106 and the electronics components 107–109 are mounted on a fixed plate (not shown). While the light source 101 moves along the subscan direction 120, a light reflected from the document propagates through the mirrors 102–104 and the lens 105 to be focused on the CCD 106. Then, after photoelectric conversion, the electric signals are processed by the read image processor 107, and the document image data are stored in the frame memory 108. The external memory 109 such as a hard disk is used to store image data stored in the frame memory 108 temporarily.

The printer 20 performs an electrophotographic process to form a toner image on a transfer paper. In the printer 20, an eraser 207 for discharging, a sensitizing charger 202, a print head 203, a developing device 204, a transfer device 205 and a cleaner 206 are arranged successively around a photoconductor drum 201.

The print head 203 comprises, for example, a laser diode. The intensity of the light emitted by the print head 203 is modulated according to the output data of an image processor 208. The image processor 208 processes the image data stored in the frame memory 108, as will be explained later in detail with reference to FIG. 4.

Figure 2:
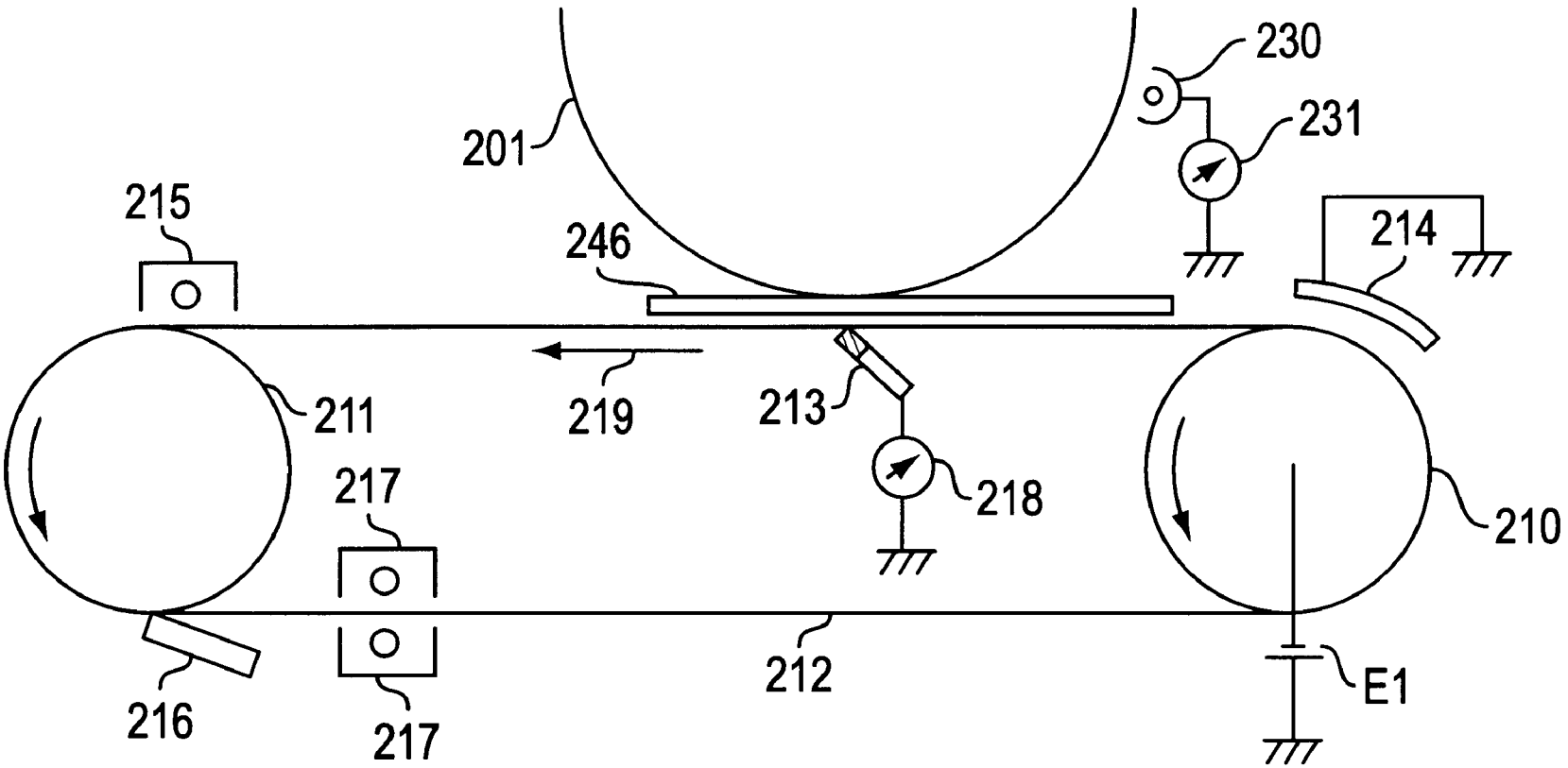
FIG. 2 is a schematic sectional view of a transfer section of the copying machine.

The transfer device 205, as shown in FIG. 2, comprises a transfer belt 212 extended between a roller 210 and a drive roller 211 and a sensitizing brush 213 for transfer. This copying machine has a feature that include the sensitizing brush 213 used for transfer. The sensitizing brush 213 is arranged near the photoconductor drum 201, but at a rear side of the belt 212. A negative DC voltage E1 is applied to the roller 210, while a guide 214 connected to the ground is arranged opposite to the roller 210. A transfer paper 246 passes between the roller 210 and the guide 214, so that the paper 246 is absorbed or attracted toward the transfer belt 212 electrostatically.

A separation charger 215 is set near the roller 211 in front of the transfer position of the photoconductor drum 201 with respect to the carriage direction of the paper in order to separate the transfer paper 246 from the transfer belt 212. A cleaner blade 216 and a discharger 217 are arranged along an opposite side of the transfer belt 212 from the roller 211 to the other roller 210 in order to guarantee the repetitive use of the transfer belt 212.

The sensitizing brush elements 213 contact the back plane of the transfer belt 212, so that the transfer belt 212 is charged according to a DC voltage applied by a power source 218. Then, a coulomb force is exerted to a toner image adhered onto the photoconductor drum 201, and the toner image is transferred to the transfer paper 246.

Figure 3A:
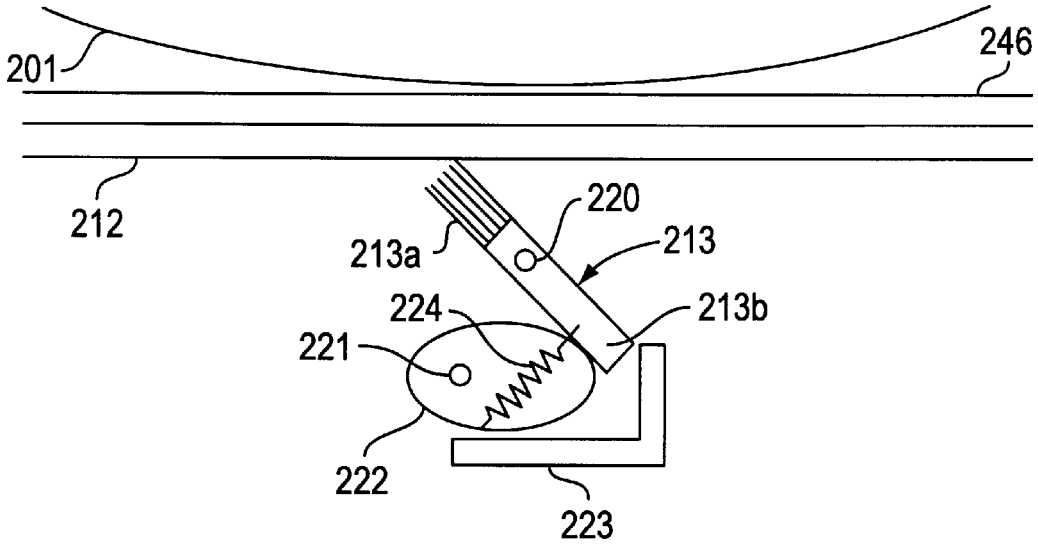
FIGS. 3A and 3B are a sectional view and a perspective view of a support mechanism of a sensitizing brush.
Figure 3B:
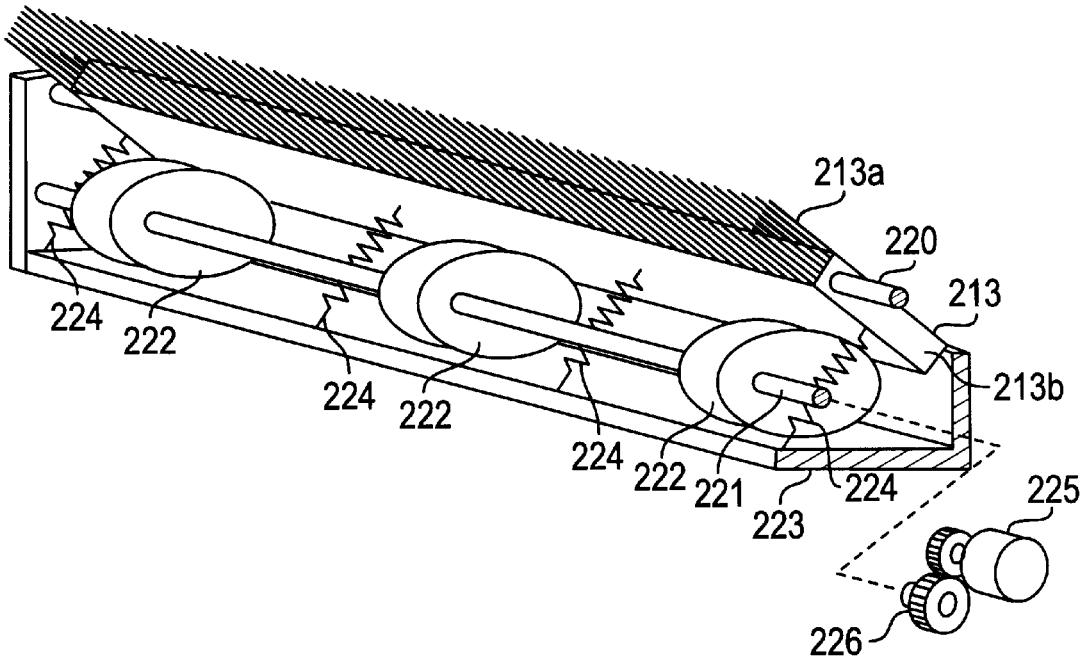

The pressure of the sensitizing brush 213 to the transfer belt 212 can be changed, and this affects the transfer conditions. FIGS. 3A and 3B show a support mechanism of the sensitizing brush 213. The brush 213 has the same length along a lateral direction as the transfer belt 212, and its top brush 213*a* contacts with a back plane of the transfer belt 212. A holder 213*b* of the brush 213 is supported so as to be rotated around a horizontal axis 220, while an eccentric cam 222 is fixed to another axis 221 in parallel to the horizontal axis 220. A spring 224 is provided between a base 223 and a holder 213*b* of the brush 213, so that an elastic stabilizing force of the spring makes the holder 213*b* contact the periphery of the eccentric cam 222. Thus, the brush 213 changes its posture according to a rotation angle of the eccentric cam 222, and the transfer pressure against the transfer belt 212 is controlled.

As a Variation, if a transfer charger is used for transfer instead of the brush 213, a MYLAR (polyethylene terephthalate) film is set to be pushed up, and an amount of pushing up is controlled for transfer.

Referring to FIG. 1 again, an eraser lamp 230 is provided around the photoconductor drum 210 near the developing device 204 rather than near the transfer section 205. This eraser lamp 230 is called as pretransfer eraser. The intensity of a light emitted by the pretransfer eraser 230 is controlled by the DC power source 231 connected to the pretransfer eraser 230 (refer to FIG. 2).

Two cassettes 240 and 241 storing transfer papers are provided in a space below the transfer section 205. A roller 242, 242*a* supplies a transfer paper 246 from the cassette 240, 241, and the transfer paper 246 is guided through the carriage guide 244 and the timing roller 245 toward the transfer belt 212.

On the other hand, another guide 250 and fixing rollers 251 are arranged in front of the transfer belt 212 along the carriage direction 219, and a separation charger 215 is provided around the drive roller 211 for separating the transfer paper 256 from the belt 212. A cleaner blade 216 and a desensitizing charger 217 are set along the transfer belt 212 to guarantee reuse of the transfer belt 212.

Figure 4:
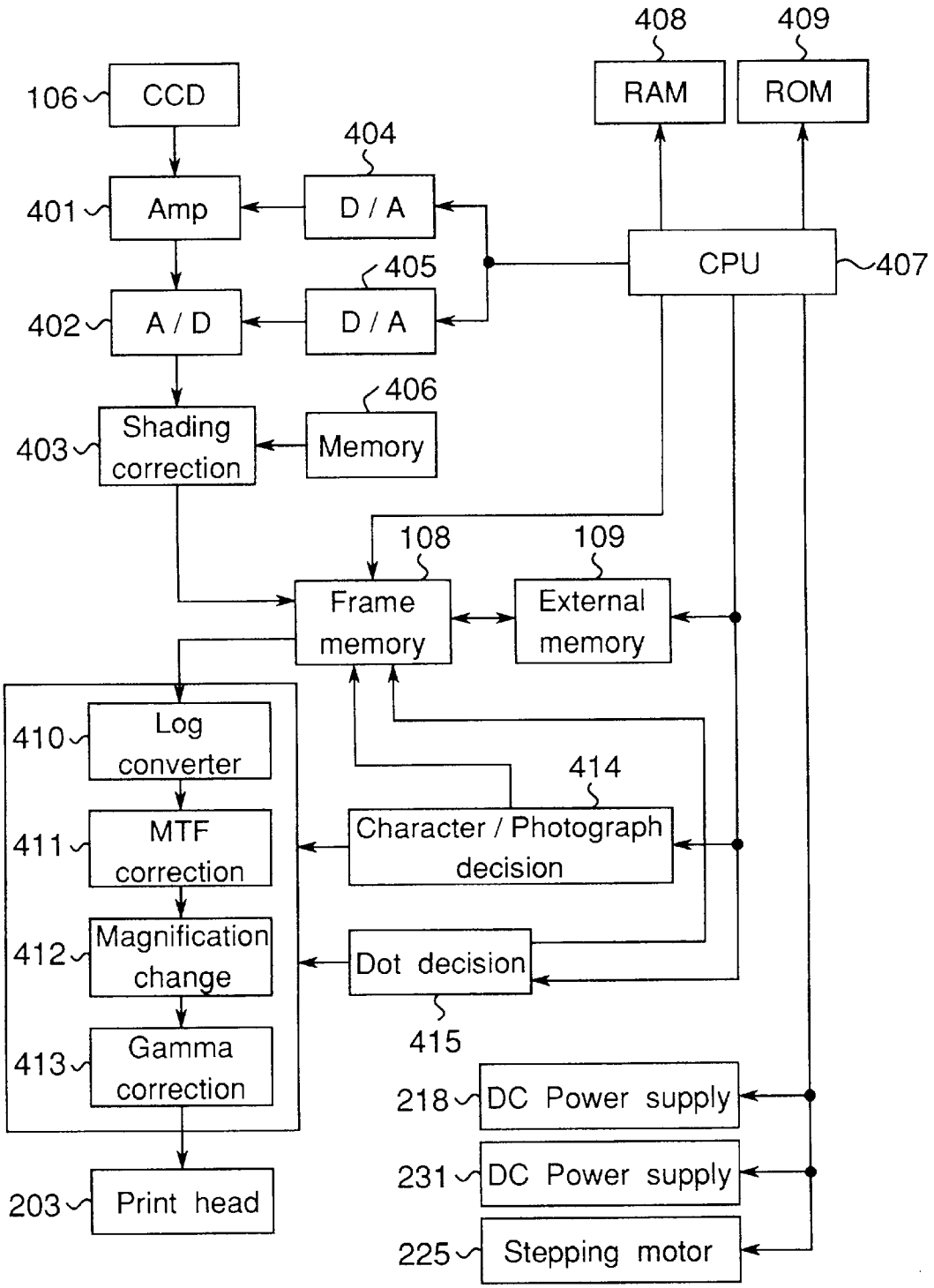
FIG. 4 is a block diagram of an image processing system of the copying machine.

FIG. 4 shows a block diagram of an image processing system of the copying machine from the time optical signals are received by the CCD 106 until image data are sent to the print head 203. An analog electric signal output by the CCD 106 is amplified by an amplifier 401 and converted to a digital signal by an analog-to-digital (A/D) converter 402. Then, the digital signal is subjected to shading correction by a shading correction section 403. Next, the signal is stored once in a frame memory 108. It is also possible to store the signal in an external memory 109 such as a hard disk according to an instruction by a central processing unit (CPU) 407. A digital-to-analog (D/A) converter 404 sets a gain of the amplifier 401 according to an instruction by the CPU 407, and another digital-to-analog (D/A) converter 405 sets a reference voltage of the A/D converter according to an instruction by the CPU 407. A memory 406 connected to the shading correction section 403 stores initial data for shading correction.

The CPU 407 controls variable a pair of DC power sources 218, 231 and a stepping motor 225 to control transfer conditions according to features of the document image data, as well as the entire image processing system. A read-only-memory (ROM) 409, connected to the CPU 407, stores predetermined transfer conditions and the like.

A log converter 410 converts document image data stored in the frame memory 108 from reflectance data to density data. Then, the data are subjected to a mutual transfer function (MTF) correction by an MTF correction section 411, and the data are changed according to a magnification power by a variable magnification section 412. Then, the data are subjected to gamma correction by a gamma correction section 413. The obtained data are sent to the print head 203 for exposing the photoconductor drum 201.

In the copying machine, transfer conditions are determined according to attributes of the document image. The attributes are determined by a character/photograph section 414 and a dot decision section 415. A character/photograph decision section 414 generates a histogram according to document image data stored in the frame memory 108 and decides the attributes of the document according to the histogram. Then, the attributes are stored in a random access memory (RAM) 408. Further, a dot decision section 415 converts the data of a document stored in the frame memory 108 to frequency components and decides the attributes of a document according to features of the data. The result of the decision is stored in the RAM 408.

Figure 5A:
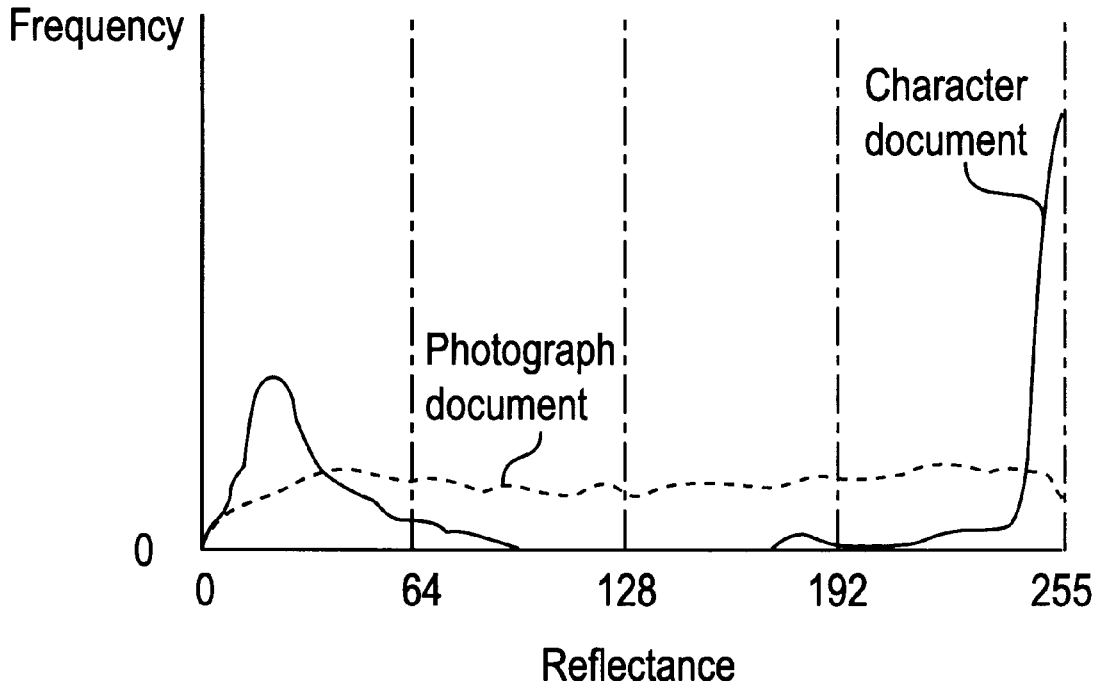
FIG. 5A is a histogram of examples of document data generated by a character/photograph decision section.

The operation of the character/photograph decision section 414 is explained. FIG. 5A shows examples of a histogram generated by the character/photograph decision section 414 for image data of 256 gradation levels. For an example of a photograph document, there are practically no peaks between 0 and 255, and frequencies are about the same for each level. On the other hand, for an example of a character document, image data has two peaks around levels 0–6 for characters and around level 255 for white background. By using these features, a character document and a photograph document can be distinguished from each other. For a document including both characters and photographs, a histogram thereof is like a sum of the histograms of two types shown in FIG. 5A, though it depends on resolution of the scanner 10. Then, such a document is classified as not belonging to either of the character and photograph documents.

Figure 5B:
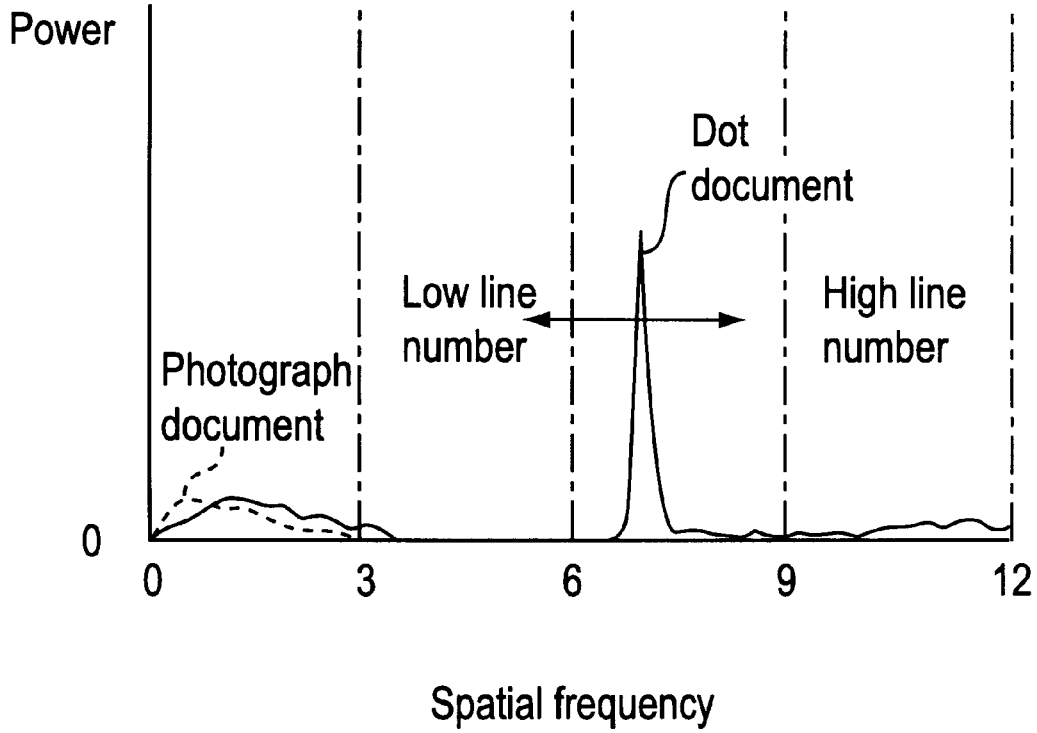
FIG. 5B is a histogram of examples of document image generated by a dot image decision section.

Next operation of the dot decision section 415 is explained. FIG. 5B shows examples of spatial frequency components obtained by the dot decision section 415. For a photograph document, the power is concentrated around low spatial frequencies, and no peak exists. On the other hand, for a dot document, a peak exists at high frequencies in correspondence to the line number of the dot document. By using such a feature, a dot document can be discriminated from a photograph document. It is also possible to classify dot documents according to the peak frequency.

In order to solve problems occurring in the transfer process, the transfer conditions are controlled according to the decisions of the character/photograph decision section 414 and the dot decision section 415. For a character document, a quantity of light of the pretransfer eraser 230 is set at a small value according to reasons described below. A character document is expressed as a bi-level image, and it has a feature that an amount of toners per unit area is large on areas in correspondence to black characters on the photoconductor. Therefore, if the intensity of light is large, a potential difference exist between areas on which toners are adhered and surrounding areas without any toners that correspond to a white background. As a result toners on the areas may scatter onto surrounding areas. A transfer pressure of the brush 213 is set at a small value according to a reason described below. If the transfer pressure is high, a nip width (or a width of a portion where the photoconductor 201 contacts with a transfer paper) becomes wider, and toners are liable to gather there to cause a phenomenon of missing inside. A transfer current is set at a large value to transfer the toner image sufficiently because the amount of toners is large.

For a photograph document, toners adhere to the entire image on average. As a result transfer conditions are set to prevent discharge noises and to improve homogeneity of transfer. That is, the intensity of the pretransfer eraser 230 is set at a large level to remove any excess charges sufficiently, and the transfer current is set at a small value to prevent discharge noises. Further, the transfer pressure of the brush 213 is set at a high value in order to stabilize the nip width and to improve the homogeneity of transfer.

A dot document having a large number of lines (referred to as high frequency dot document) has features similar to a photograph document. As a result, the transfer conditions are set similarly to those set for the photograph document. Because the transfer pressure of the brush 213 is set at a high value, voids which are liable to occur in a dot document can be prevented. A void is a phenomenon that occurs when the transfer of dots becomes insufficient due to flowout of carriers.

A dot document, having a small number of lines (referred to as low frequency dot document) is more similar to a character document than a high frequency dot document. For example, an amount of adhered toners per unit area thereof is larger that of a high frequency dot document. As a result transfer conditions are intermediate between those of the high frequency dot document and the character document. That is, the quantity of light of the pretransfer eraser 230 is set at a middle value to prevent the scattering of toner and also to prevent discharge noises, and the transfer current is set at a middle value in order to transfer toners sufficiently while preventing discharge noises. The transfer pressure of the brush 213 is set at a high value to prevent voids because there is only a small possibility of missing inside.

As to the setting of the transfer conditions, the transfer current is set between about 20 and 100 $\mu$A by using the brush 230 or a roller (not shown) for transfer charging. If the transfer charger is used, a total amount is set to be 5 to 6 times the above-mentioned value. The transfer pressure is set to be spring pressure of the brush for transfer charging, a roller, a push-up mylar or the like of about 500–600 g.f, or a line pressure of about 160–200 g/cm. The intensity of light emission of the pretransfer eraser 230 may be set appropriately between about 0 and about 0.1 mW/cm$^2$. These ranges and the small, middle and high values therein used for setting the transfer conditions are set suitably be confirming actual copies obtained by an actual copying machine.

Figure 6:
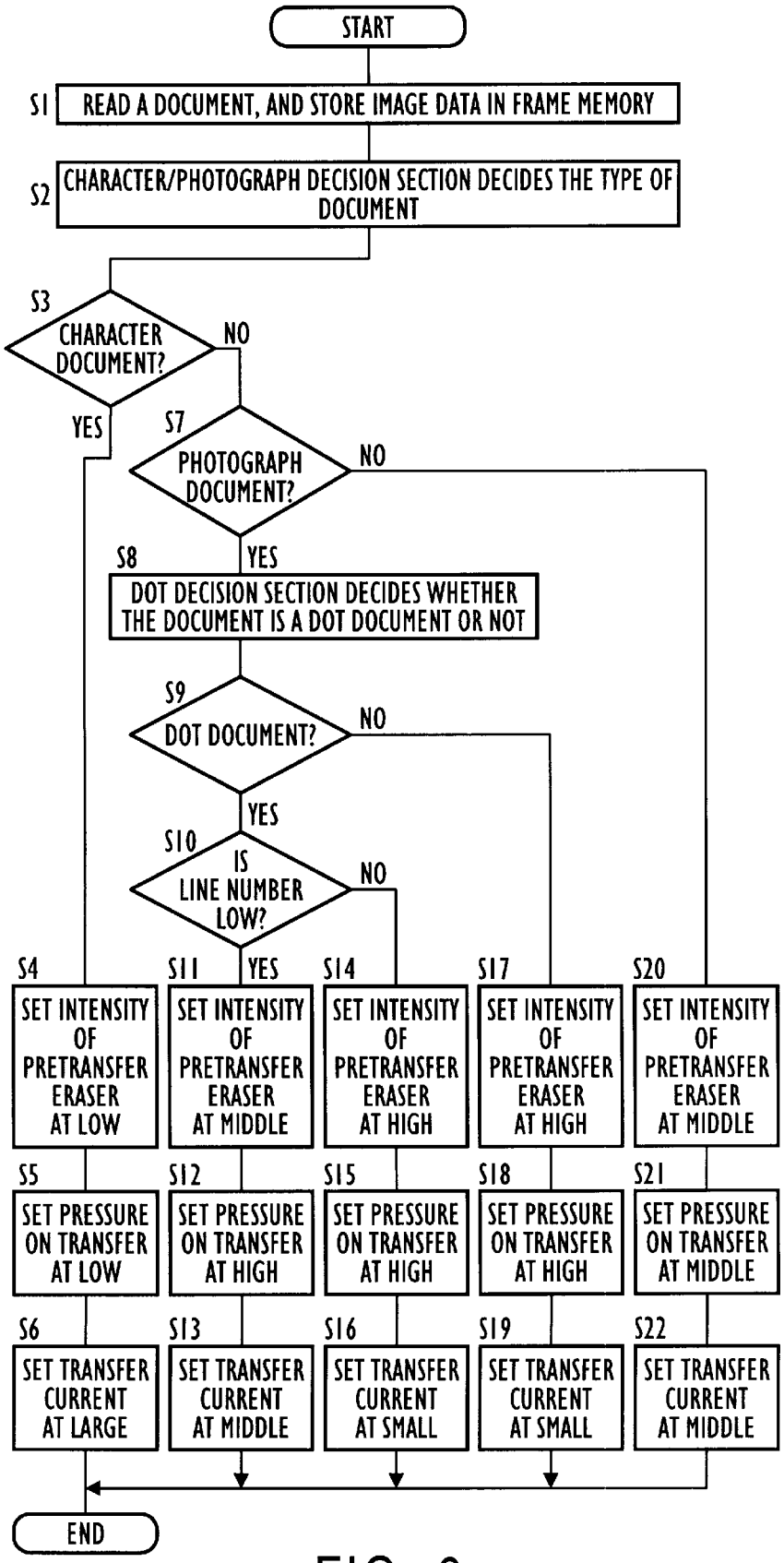
FIG. 6 is a flowchart of image processing.

FIG. 6 is a flowchart for controlling the transfer conditions according to the decisions of the character/photograph decision section 414 and the dot decision section 415. First, image data of a document read by the image scanner 10 is stored in the frame memory 108 (step S1). Then, the character/photograph decision section 414 generates a histogram of the image data and decides whether the document is a character document or a photograph document (step S2). Then, the flow branches according to the type of the document (steps S3 and S7).

If the document is decided to be a character document (YES at step S3), conditions for a character document are set. That is, a quantity of light of the pretransfer eraser 230 is set at a small value (step S4), a transfer pressure of the brush 213 is set at a low value (step S5), and a transfer current is set at a large value (step S6).

If the document is decided to be a photograph document (YES at step S7), the flow proceeds to step S8 to decide further by the dot decision section 415 if the document is a dot document or not (step S8). If the document is decided to be a dot document (YES at step S9), transfer conditions are set according to whether the number of lines of dots is high or small. If the line number is high (YES at step S10), the document is a dot document having a small line number (low frequency dot document). Then, a quantity of light of the pretransfer eraser 230 is set at a middle value (step S11), a transfer pressure is set at a large value (step S12), and a transfer current is set at a middle value (step S13). On the other hand, if the line number is decided to be large (No at step S10), the document is a dot document having a large line number (high frequency dot document). Then, a quantity of light of the pretransfer eraser 230 is set at a high value (step S14), a transfer pressure of the brush 213 is set at a high value (step S15), and a transfer current is set at a small value (step S16).

If the document is decided not to be a dot document (NO at step S9), the document is treated as a photograph document not including dots. Then, a quantity of light of the pretransfer eraser 230 is set at a high value (step S17), a transfer pressure of the brush 213 is set at a high value (step S18), and a transfer current is set at a small value (step S19).

If the document is decided not to be either and a character document and a photograph document (NO at step S7), the document includes both character and photograph images. Then, a quantity of light of the pretransfer eraser 230 is set at a middle value (step S20), a transfer pressure of the brush 213 is set at a middle value (step S21), and a transfer current is set at a middle value (step S22). Because the document has various features, these conditions are set to regenerate a good image which is good on the average.

In the embodiment explained above, the transfer belt 212 and the brush 213 are used for the transfer. However, a transfer drum, a transfer charger, a sensitizing roller for transfer or the like may also be used.

In the embodiment explained above, both the character/photograph decision section 414 and the dot decision section 415 are used to set transfer conditions. However, the transfer conditions may also be set according to the decision of one of the two sections 414 and 415.

Figure 7:
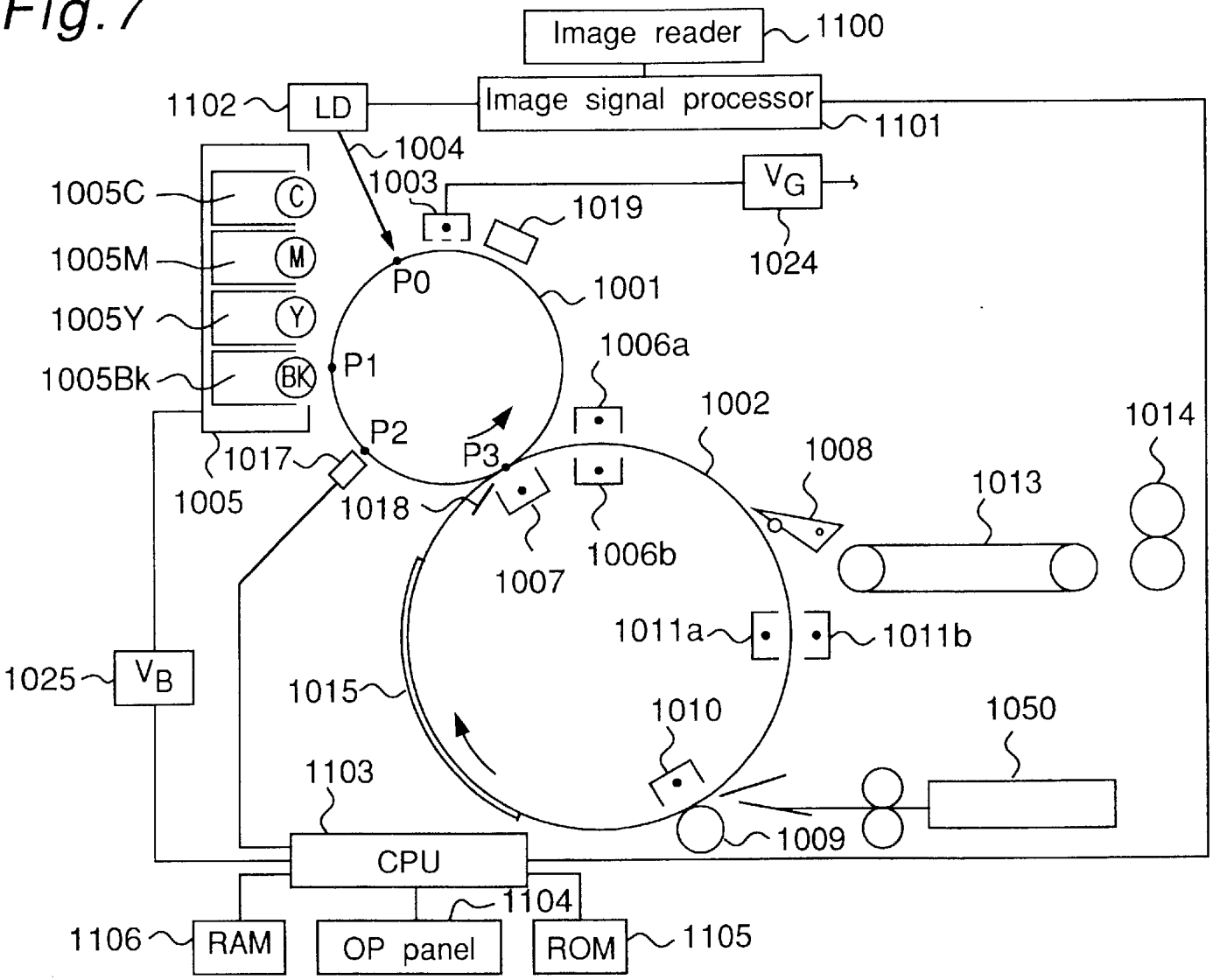
FIG. 7 is a schematic sectional view of a digital color copying machine of a second embodiment.

Next, a digital color copying machine of a second embodiment of the invention is explained. FIG. 7 shows the digital color copying machine schematically. This copying machine has the features including a transfer charger 1007 used for transfer and an eraser lamp 1017 provided before the transfer point.

In FIG. 7, a document reading section 1100, which is not explained in detail in this embodiment, reads image data of a document and outputs the read data to an image signal processor 1101. The processor 1101 converts the image data to gradation data and generates laser diode drive signals to make a laser diode (LD) 1102 in a print head emit a beam 1004. The processor 1101 further discriminates character areas and photograph areas in the image data of the document, and these discrimination results are sent to a CPU 1103. The CPU 1103 stores the results in a random access memory (RAM) 1106. The photoconductor 1001 is charged uniformly negatively with a sensitizing charger 1003 driven by a $V_G$ generator unit 1024 controlled by the CPU 1103, and the laser beam 1004 exposes the photoconductor 1001 at point P0 to form an electrostatic latent image on the photoconductor 1001 rotated anti-clockwise.

A developing unit 1005 including a developing device 1005C for cyan (C), a developing device 1005M for magenta (M), a developing device 1005Y for yellow (Y), and a developing device 1005BK for black (BK) are moved up and down by a motor (not shown). One of the developing devices located at developing point P1 and driven by a $V_B$ generator unit 1025 forms a visible toner image on the electrostatic latent image with toners of negative charges at point P1 on the photoconductor 1001. The developing devices 1005C–1005BK use a two-component developing material which consists of the toner and the carrier.

At point P2, a pretransfer eraser 1017 discharges the surface of the photoconductor 1001 by emitting a light. The CPU 1103 reads control data stored in a data read only memory (ROM) 1105 according to the operation mode specified by an operational panel 1104 and the result of the image discrimination by the image signal processor 1101, and it controls the amount of discharging of the surface or the intensity of the exposure of the eraser 1017 according to the read control data. At point P3 at the transfer point, the toner image is transferred onto a transfer material 1015 which have been adsorbed and carried electrostatically with a clamping roller 1009 and a charger 1010 for absorption.

In order to prevent the electric field from the transfer charger 1007, a restriction member 1018 for restricting the electric field is arranged at the upstream side in the direction of the drum rotation with respect to the transfer charger 1007, in a gap at the upstream side with respect to a contact point of the transfer material with the photoconductor 1001. The restriction member 1018 is used mainly to suppress the so-called untimely transfer when toners move from the photoconductor 1001 to the transfer material 1015 in the gap. If the untimely transfer occurs, toners are scattered around characters in an image. The restriction material 1018 is usually made of a material of a resin film such as polyethylene terephthalate (PET). Moreover, in order to prevent irregular transfer, a multi-layer member may be used that includes a resin film having a low resistance interposed with PET films or the like.

A series of operations of exposure, deposition and transfer is performed on the four colors of cyan (C), magenta (M), yellow (Y) and black (BK), the absorbing force to the transfer film is weakened by AC chargers 1006*a* and 1006*b* for separation and discharging, and the transfer material 1015 is separated by the separation member 1008 from the transfer drum 1002. Then, the transfer material is carried by a carriage deck 1013 to a fixing roller 1014 for fixing. After the transfer material 1015 is separated, the transfer film on the surface of the transfer drum 1002 is discharged by the AC chargers 1011*a* and 1011*b*.

Figure 8:
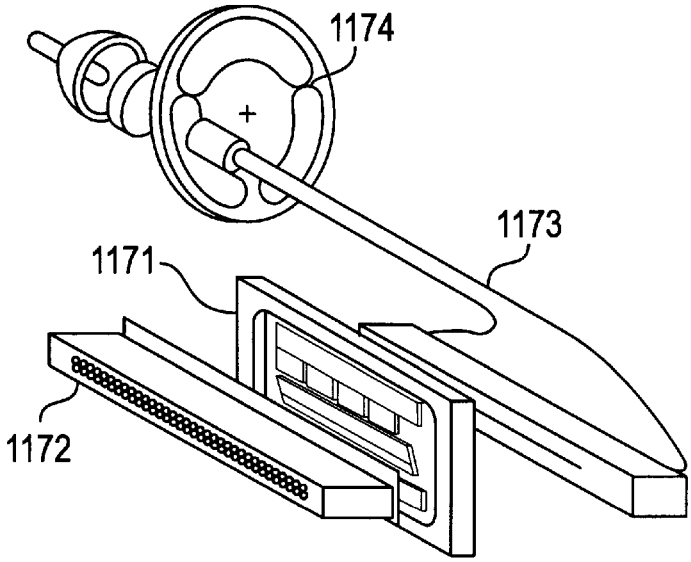
FIG. 8 is a perspective view of a pretransfer eraser.

FIG. 8 shows the pretransfer eraser 1017. The eraser 1017 comprises an optical shutter array 1171 using a PLZT element where the resolution is 300 dots per inch (dpi), both in the main scan direction and in the subscan direction. The optical shutter array 1171 is provided between a selfoc lens array 1172 and a linear light source 1173. A filter 1174 is set behind the linear light source 1173. Because the filter 1174 is used, the quantity of light (optical intensity) can be controlled to be changed at three steps in this embodiment.

The light source 1173 emits a uniform light, and the optical shutter array 1171 controls transmittance by applying an electric voltage for each pixel to the PLZT element. That is, after transmitting each pixel through the optical shutter array 1171, the light emitted from the light source 1173 is transmitted or not transmitted by the optical shutter array 1171. By using the pretransfer eraser 1017, charges on the photoconductor 1001 can be removed with different quantities of light for the character areas and photograph areas. It is preferable that the resolution is higher. However, if the resolution is about 100 dots per inch or higher, the quantity of light can be controlled according to the boundaries between the character and photograph areas.

Figure 9A:
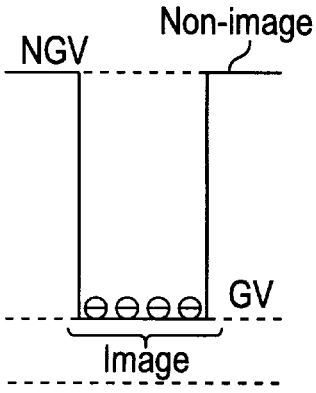
FIGS. 9A, 9B and 9C are diagrams for illustrating transition of the potential GV of an image area and the potential NGV of a non-image area from the developing point to the transfer point.
Figure 9B:
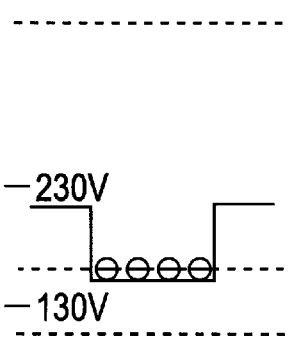
Figure 9C:
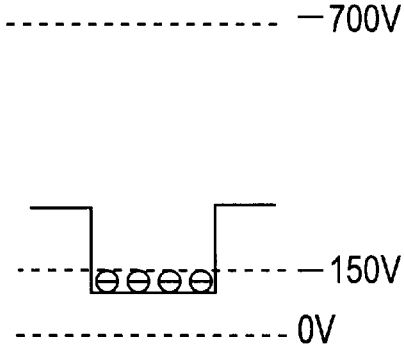

Next, before explaining the operation of the pretransfer eraser 1017, the potential of the photoconductor 1001 is explained. FIGS. 9A, 9B and 9C show schematically, successive transition of the potential of an image area and a non-image area from the developing point P1 to the transfer point P6. An open circle in the drawings denotes a toner adhered onto the surface of the photoconductor 1001. The sign "–" in the open circle means that the toner is negatively charged. This expression is common in FIGS. 11, 12 and 13.

The photoconductor 1001, which has been sensitized uniformly, is exposed at point P0 (FIG. 7) by the laser beam 1004. FIG. 9A shows the potential of an non-image area (that is, surface potential $V_o$) and the potential at an image area where the photoconductor 1001 is exposed with the laser beam of 0.8 mW/cm$^2$ after the photoconductor 1001 has been sensitized by using the grid potential of −750 V of the sensitizing charger 1003. Hereinafter, NGV denotes potential of a non-image area, and GV denotes potential of an image area. In this case, the potential NGV becomes about −700 V and the potential GV becomes about −150 V. For convenience of the explanation, when the absolute value of the potential decreases, it is said hereinafter that the potential decreases.

The potential NGV of the non-image area is decreased with discharging by the pretransfer eraser 1017 at point P2 shown in FIG. 7. FIG. 9B shows the potentials GV and NGV of the image area and the non-image area subjected to discharging by the pretransfer eraser 17 when a quantity of light of the pretransfer eraser 1017 of 0.5 mW/cm$^2$ exposes both the image and non-image areas. In this case, the potential NGV of the non-image area decreases to about −230 V while the potential GV of the image area decreases by about 20 V to about −130 V. FIG. 9C shows the potentials GV and NGV at the transfer point (point P3 in FIG. 7) where the photoconductor 1001 contacts the transfer drum 1002. The potentials NGV and GV of the non-image area and the image area decrease further by about 10–20 V.

Figure 10A:
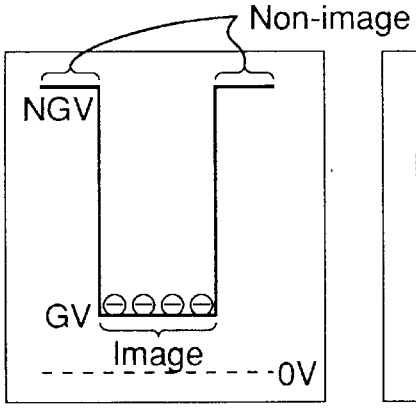
FIGS. 10A, 10B, 10C, 10D, 10E and 10F are diagrams for illustrating the potential NGV of a non-image area and the potential GV of an image area at point P2 when the intensity of light emission of the pretransfer eraser is increased.
Figure 10B:
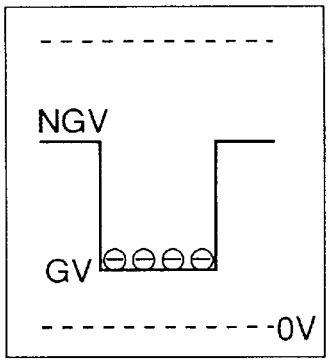
Figure 10C:
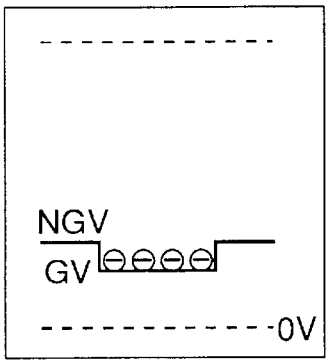
Figure 10D:
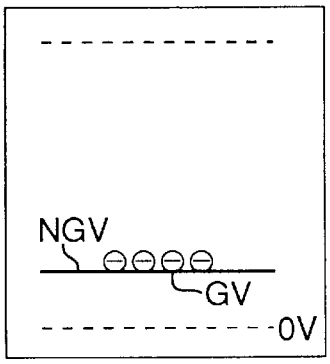
Figure 10E:
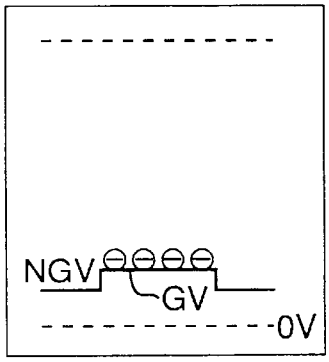
Figure 10F:
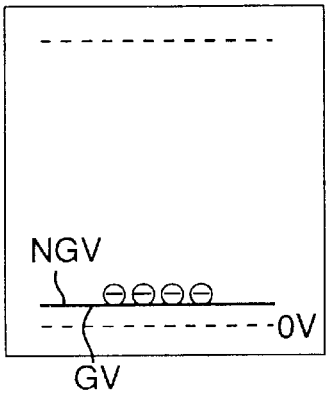

FIGS. 10A–10F show a relation between the non-image area potential NGV and the image area potential GV of the photoconductor 1001 when the intensity of light emitted by the pretransfer eraser 1017 is gradually increased. As will be understood by comparing FIGS. 10A–10C, as the intensity of the pretransfer eraser 1017 is increased, the potential NGV of the non-image area drops, while the potential GV of the image area remains almost the same. Then, as shown in FIG. 10D, when the intensity is increased further, the potentials GV and NGV of the image area and the non-image area become almost the same. As shown in FIG. 10E, if the intensity is increased further, the potential NGV of the non-image area becomes smaller somewhat than the potential GV of the image area. As shown in FIG. 10F, if the intensity is increased further, the potential GV and the potential NGV of the image area and the non-image area drop to the level of the residual potential (almost 0 V) of the photoconductor 1001. The transition of the potentials NGV and GV to the intensity against the intensity of the pretransfer eraser 1017 becomes similar though it depends on the color and the adhered amount of toners.

As will be explained in detail later, the intensity of light of the pretransfer eraser 1017 is controlled to suppress phenomena such as discharge noises, narrowing or thickening of a linear image (scattering of toners), missing inside and adhesion of carriers that deteriorate the image quality of a reproduced image. Further, the optical intensity is also controlled according to a difference of the image such as a character image (bi-level image) or a photograph image (multi-level image), gradation reproduction process such as bi-level (area) exposure or the gradation method or a multi-level exposure gradation method, or the setting of edge emphasis (sharpness mode) and the like. These modes are set by a user with the operational panel 1104, and the optical intensity is controlled according to a mode set by a user.

Before explaining the operation of the pretransfer eraser 1017, a relation between the intensity of light emitted by the pretransfer eraser 1017 and the image quality of a reproduced image is explained on the various phenomena that deteriorate image quality.

First, discharge noises are explained. When a voltage difference between the surface of the photoconductor 1001 and the surface of a transfer material 1015 exceeds the discharge starting voltage of Paschen, discharge occurs between these surfaces. When the discharge occurs in a gap region before the transfer point (point P3 in FIG. 7) where the transfer material 1015 comes in contact with the photoconductor 1001, negative charges are injected from the photoconductor 1001 onto the transfer material 1015. An area in the transfer material 1015 where the negative charges are injected has a weaker coulomb force. Therefore, the negatively charged toners tend not to be attracted easily, and an amount of adhered toners becomes insufficient for reproduction. As a result the image may have a white area due to insufficient transfer. This white area is called discharge noise.

Table 1 shows a relation of frequency of generation of discharge noises to the potential NGV of the non-image area of the photoconductor 1001. In Table 1, open circle "o" means that discharge noises are not generated, open triangle "Δ" means that the frequency of generation of discharge noises is low, and sign "×" means that the frequency of generation of the discharge noises is high.

TABLE 1

Generation of discharge noises

| Potential on the surface of photoconductor (V) | Generation of discharge noises |
|---|---|
| −50 | ○ |
| −100 | ○−Δ |
| −150 | Δ |
| −200 | Δ |
| −250 | Δ−× |
| −300 | × |
| −350 | × |

Table 1 shows generation of discharge noises is suppressed by decreasing the potential NGV of the non-image area of the photoconductor 1001. Therefore, it will be understood that discharge noises can be prevented by decreasing the surface potential of the photoconductor 1001 (the potential NGV of the non-image area) by the pretransfer eraser 1017 before the toner image formed on the surface of photoconductor 1 arrives at the vicinity of the transfer point P3.

Figure 11A:
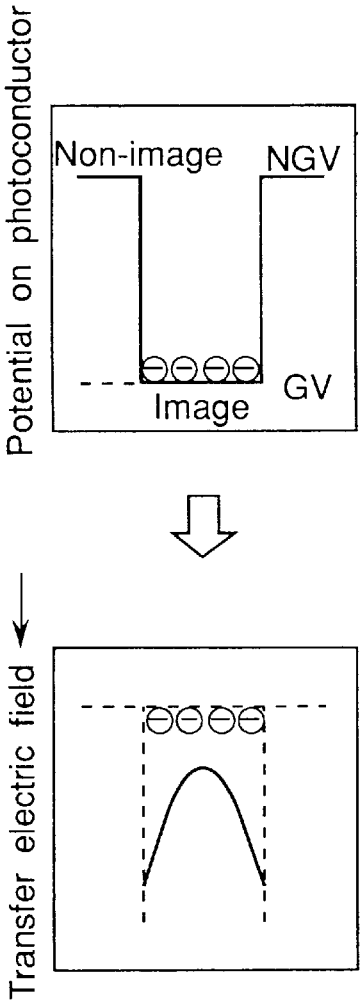
FIGS. 11A, 11B and 11C are diagrams each for illustrating a difference between the potential GV of an image area and the potential NGV of a non-image area of the electrostatic latent image of a narrow line formed on the photoconductor, at the upper side, and the transfer electric field in correspondence to the potential difference, at the lower side.
Figure 11B:
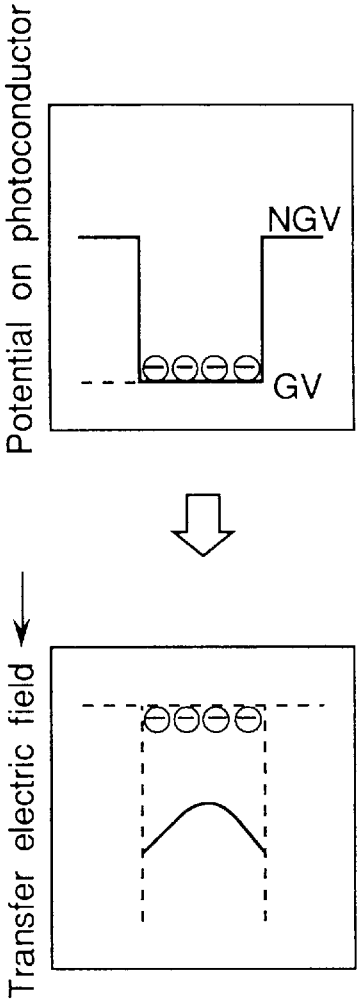
Figure 11C:
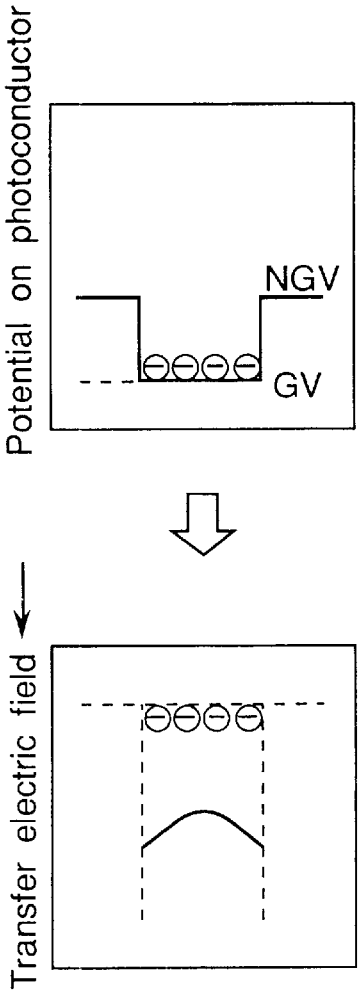

Next, missing inside is explained. In reproduction of a linear image such as a character or a very small point, there is a phenomenon (hereinafter referred to as missing inside) wherein a center part of a character or the like is not transferred easily or the center part thereof is missing. In FIGS. 11A, 11B and 11C, a difference of the potential NGV of the non-image area from the potential GV of the image area of the electrostatic latent image of a thin line formed on the surface of photoconductor 1001 is shown at the upper side, while a transfer electric field according to the difference is shown at the lower side. The difference is large in the order of FIG. 11A, FIG. 11B and FIG. 11C. It is understood that the larger the potential difference between the non-image area and the image area, the weaker the transfer electric field at the center of the image area, and that the smaller the potential difference between the non-image area and the image area, the smaller the difference of the transfer electric field between the center part and the peripheral of the image area. Missing inside is liable to occur when the difference between the potentials GV and NGV of the image area and the non-image area is large, as shown in FIG. 11A. Therefore, the missing inside can be prevented by discharging with the pretransfer eraser 1017 to decrease the difference between the potentials GV of the image area and the potential NGV of the non-image area.

Figure 12:
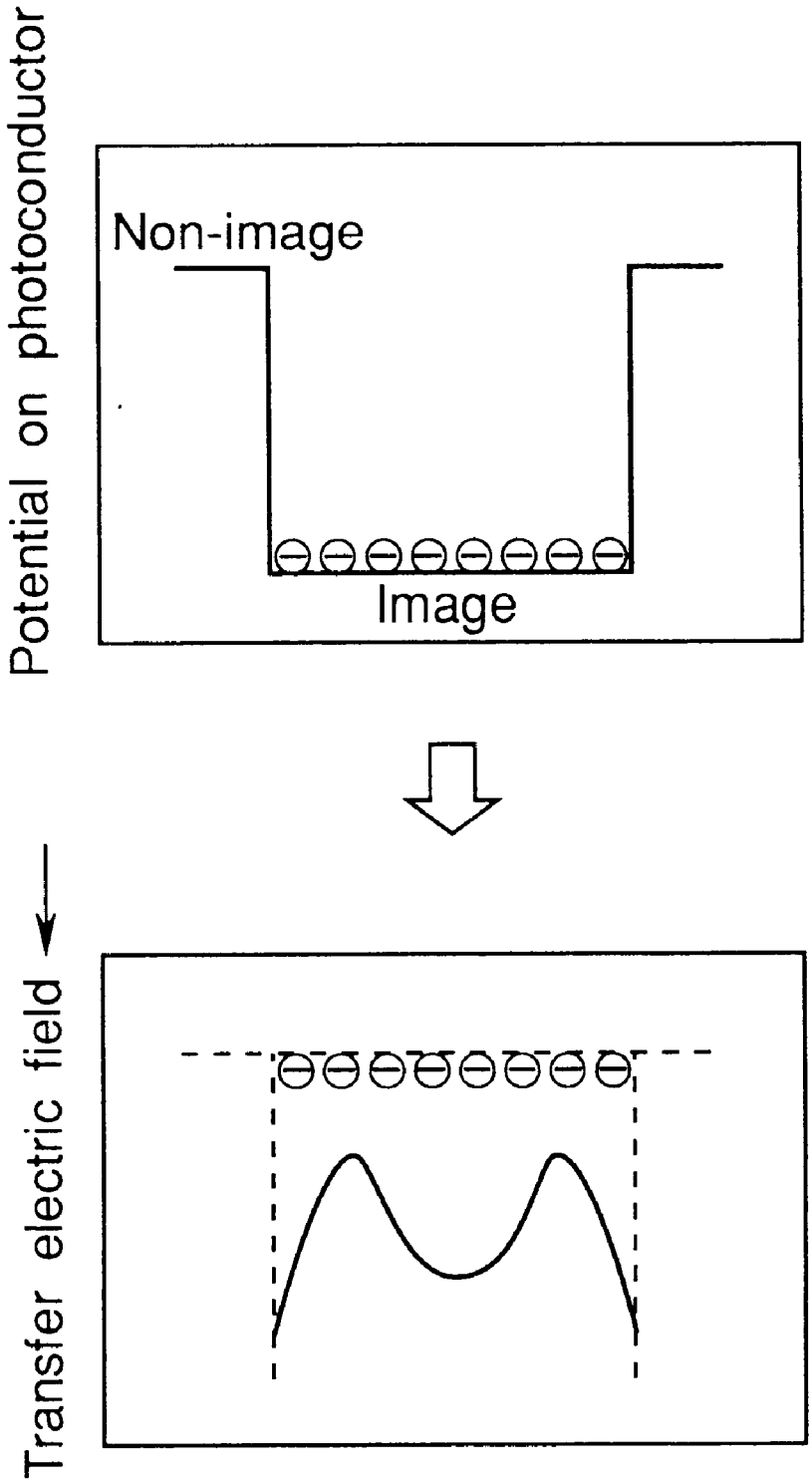
FIG. 12 is a diagram for illustrating the difference between the potential GV of an image area and the potential NGV of a non-image area on an electrostatic latent image of a bald line at the upper side and the transfer electric field in correspondence to the potential difference at the lower side.

For comparison, FIG. 12 shows the potential of an image of a bald line on the photoconductor 1001 at the upper side and the transfer electric field thereof at the lower side. The upper side shows the difference between the potential GV of the image area and the potential NGV of the non-image area of an electrostatic latent image of a bald line. As shown in the lower side in FIG. 12, the potential of the non-image area does not affect the transfer electric field at the center of the bald line, and portions just inside the edge of the line are liable to be missed. However, the missing inside just inside the edge can also be suppressed by discharging with the pretransfer eraser 1017, similarly to the missing inside at the center of a narrow line shown in FIGS. 11A–11C.

Figure 13A:
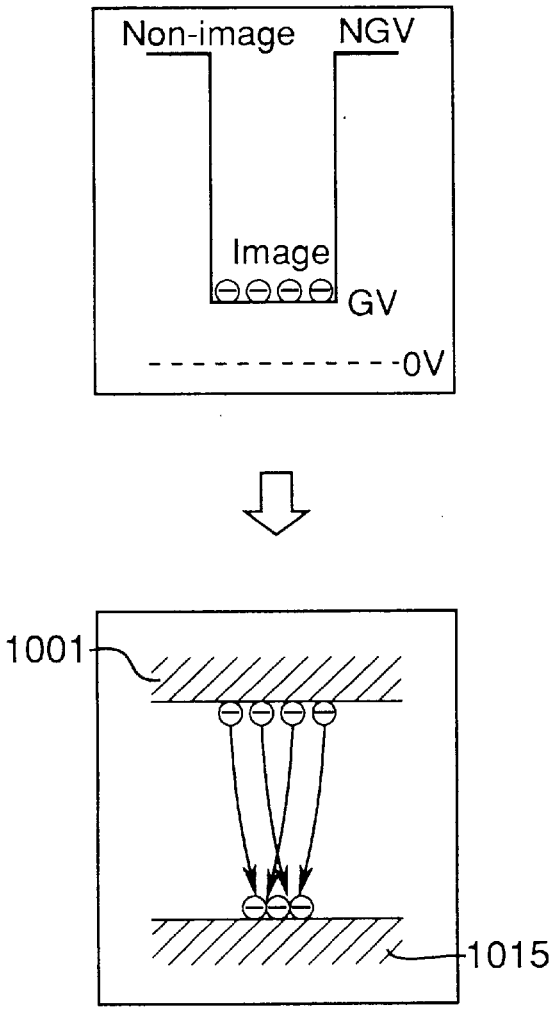
FIGS. 13A and 13B are diagram for illustrating narrowing of a linear line and scattering of toners.
Figure 13B:
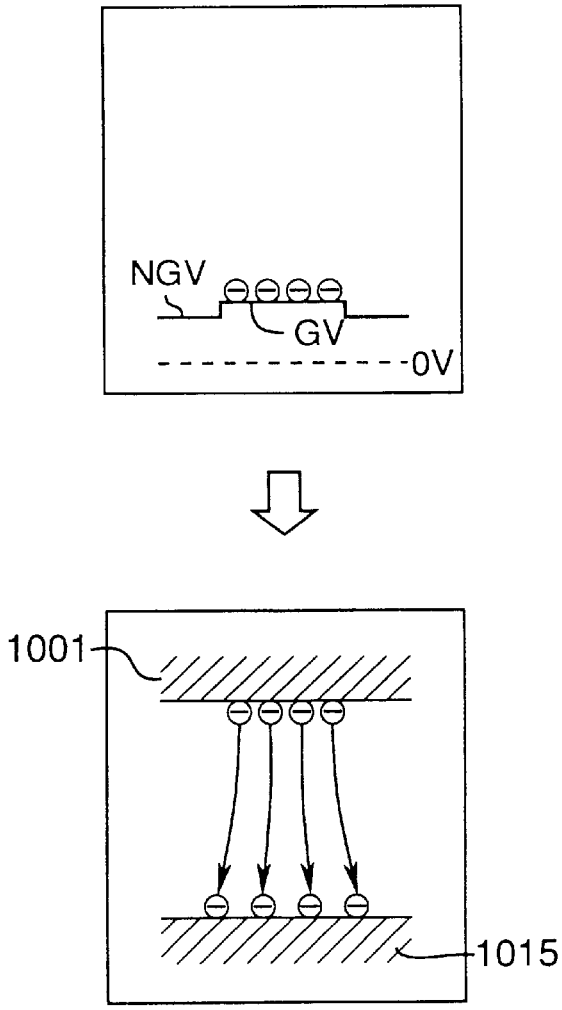

Next, narrowing of a character image and scattering of toners are explained. FIGS. 13A and 13B illustrate narrowing of a linear image of a character or the like and scattering of toners at the linear image with reference to the potential of the photoconductor 1001 at the transfer point P3. If the potential NGV of the non-image area is higher than the potential GV of the image area and the difference between them is large, as shown at the upper side in FIG. 13A, toners adhered to the photoconductor 1001 is subjected to an inward force along the width direction when they are transferred, as shown at the lower side in FIG. 13A. When the toners, which adhere to the photoconductor 1001 are transferred, they move to the transfer material 1015 narrower due to the inward force, than the width of the adhered toner image formed on the photoconductor 1001. As a result, the character image becomes narrower. The inward force exerting on the toners becomes smaller as the potential difference between the image area and the non-image area becomes smaller. On the other hand, if the potential GV of the image area is higher than the potential NGV of the non-image area and the difference between them is small, as shown at the upper side in FIG. 13B, the toners adhered to the photoconductor 1001 is subjected to an outward force along the width direction when the toners are transferred onto a transfer material 1015, as shown at the lower side in FIG. 13B. When the toners are transferred under the outward force, the toners either adhere widely along the width direction or the toners are scattered at the transfer point P3, even if the restriction member 1018 at the gap between the photoconductor 1001 and the transfer material 1015 restricts the transfer electric field sufficiently in the upstream side of the transfer charger 1007. Thus, the linear image grows in the width direction. This phenomenon is especially liable to occur when the amount of charges in the toners is high and the amount of the adhered toners is large. Therefore, narrowing and widening of a linear image can be prevented by controlling the optical intensity of the pretransfer charger 1017 so that the potential difference between the non-image area and the image area is set in a predetermined range, preferably between 0 and 200 V, more preferably between 0 and 50 V.

Next, adhesion of carriers is explained when a two-component developing material, which consists of the toners and the carriers, is used. In general, carriers adhere more easily to the surface of photoconductor 1001 as the potential difference between the surface potential NGV of non-image area and the developing bias potential VB applied to the developing sleeve of the developing device 1005C–1005BK becomes larger. Even if the above-mentioned potential difference is the same, the amount of the adhered carriers increases according to a so-called edge effect when many potential edges exist, as in an electrostatic latent image formed on the photoconductor 1001 when the bi-level exposure method is adopted.

The manner in which the above-described phenomena can be controlled is summed up as follows: Discharge noises are harder to occur as the voltage difference between the photoconductor 1001 and a transfer material 1015 becomes smaller. The widening of a linear image (or scattering of the toners) is harder to occur as the potential difference between the image area and the non-image area becomes larger. Narrowing of a linear image is harder to occur as the potential difference between the image area and the non-image area becomes smaller. Adhesion of carriers is harder to occur as the potential differences between the potential NGV of the non-image area and the developing bias potential VB applied to the surface of the developing sleeve of the developing device 1005C–1005BK becomes smaller. Then, the copying machine controls the optical intensity of light of the pretransfer eraser 1017 so that each of the above-mentioned phenomena is hardest to occur by setting the difference between the absolute value of the potential NGV of the non-image area and that of the potential GV of the image area.

Table 2 shows frequencies of the phenomena such as the missing inside, widening of a line (scattering of toners) and narrowing of a line when the grid voltage $V_G$ of the sensitizing charger 1003 is set at −750 V and the intensity of the laser exposure of the print head 1002 is 0.8 mW/cm$^2$ in the digital copying machine. The difference between the absolute value of the potential NGV of the non-image area and that GV of the image area is changed between −100–+300 V in increments of 50 V. In Table 2, open circle "o" means that the relevant phenomenon is not observed, open triangle "Δ" means that the frequency of the relevant phenomenon is low, and sign "×" means that the frequency of the relevant phenomenon is high.

TABLE 2

| Suppression of deterioration of image | | | |
|---|---|---|---|
| Potential difference between a non-image area and an image area (V) | Missing inside | Widening of line (Scattering of toners) | Narrowing of line |
| −100 | ○ | × | ○ |
| −50 | ○ | Δ | ○ |
| 0 | ○ | Δ–○ | ○ |
| 50 | ○ | ○ | ○ |
| 100 | ○–Δ | ○ | ○ |
| 150 | Δ | ○ | ○–Δ |
| 200 | Δ | ○ | ○–Δ |
| 250 | Δ–Δ | ○ | Δ |
| 300 | × | ○ | Δ–× |

When the grid voltage $V_G$ of the sensitizing charger 1003 and the intensity of the laser exposure are changed, the frequencies of the generation of each of the phenomena are similar to results shown in Table 2 though the frequencies differ somewhat among the values of the grid voltage $V_G$ and the intensity of the laser exposure. The phenomena are also observed without using the pretransfer eraser 1017 when the grid voltage $V_G$ of the sensitizing charger 1003 and the intensity of the laser exposure are changed. The results are not shown, but almost the same as Table 2.

The results compiled in Table 2 show that the above-mentioned phenomena of missing inside, scattering or toners and narrowing of a line do not occur practically when the potential NGV of the non-image area is equal to or larger a little than the potential GV of the image area. Concretely, it is the most preferable that the absolute value of the potential of the non-image area is larger by about 50 V than that of the image area. In practice it is preferable that the difference between the absolute value of the potential NGV of the non-image area and that of the potential GV of the image area is between 0 and 200 V. Then, the intensity of the laser beam is set so that the difference is between 0 and 200 V. The intensity is determined experimentally. For example, it is set at 0.5 mW/cm$^2$ for a character image.

Figure 14:
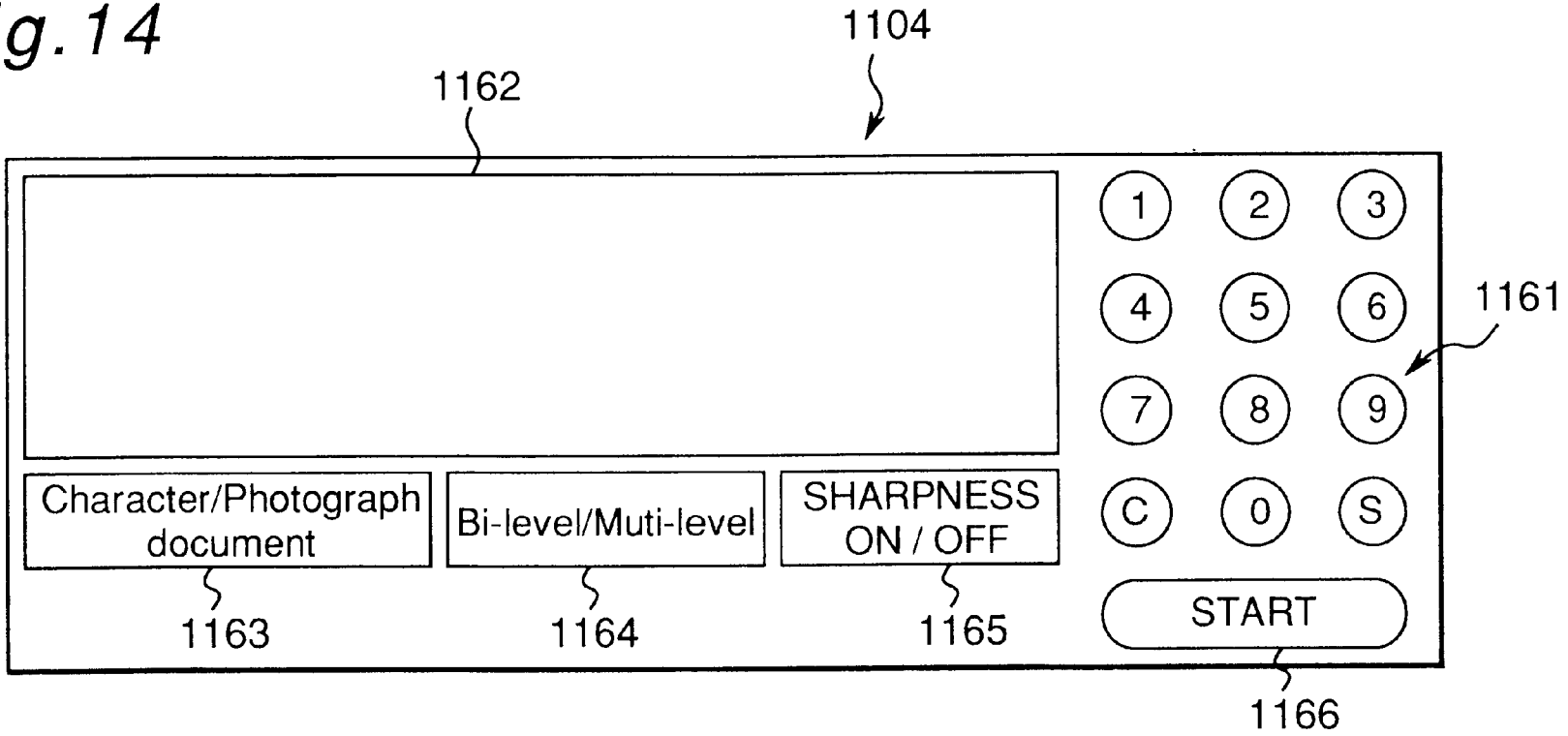
FIG. 14 is an elevational view of an operation panel of the digital color copying machine.

FIG. 14 shows the operational panel 1104 of the copying machine. The operational panel 1104 comprises a display 1162 for displaying copy conditions, mode set keys 1163, 1164 and 1165, ten-keys 1161 for setting a number of copies, and a start key 1166 for starting copy operation. The first mode key (character/photograph document key) 1163 is provided to set a mode for the reproducing gradation of an image wherein the optical intensity of light of the pretransfer eraser 1017 is controlled according to whether the document image is a character image or a photograph image. The second mode key (bi-level/multi-level key) 1164 is provided to designate or select the multi-level exposure gradation method or the bi-level exposure gradation method (or area gradation method) accompanied with dither processing. The gradation method using the multi-level exposure is a well-known method which changes the optical intensity or emitting time of the laser diode 1102 according to the density of image. The bi-level exposure gradation method expresses the density of image by changing an area of a bi-level pixel. The multi-level exposure gradation method is used when the other two modes are set. In the multi-level exposure gradation method, the potential of the photoconductor is changed according to the density. The third mode key (sharpness on/off key) 1165 is provided to set the sharpness mode. The sharpness mode is provided to emphasize the density change in an image more like edge emphasis, and it is set, for example, when a linear image, a map or the like is reproduced.

Figure 15:
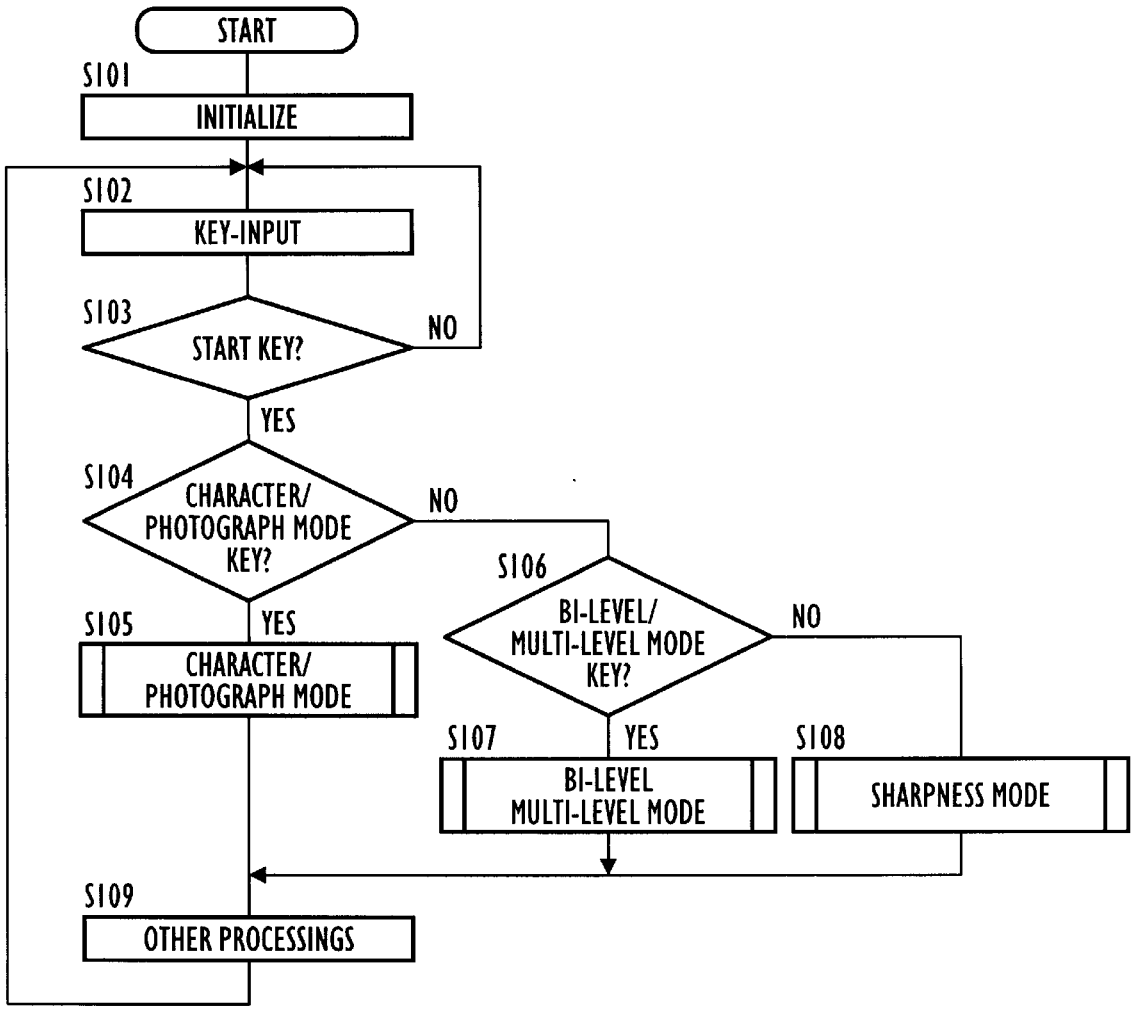
FIG. 15 is a flowchart of the copy operation of the digital color copying machine.

Next, the control of the transfer by the CPU 1103 in the second embodiment is explained. FIG. 15 shows a flow of the copy operation of the CPU 1103. First, after the copying machine is initialized (step S101), a key-input by a user is accepted (step S102) until the start key 1166 is pressed (YES at step S103). If a key-input of mode is pressed before the start key 1166, the flow branches according to the mode. If it is decided that the mode of the photograph/the character is set (YES at step S104), the character/photograph mode processing is executed (step S105, refer to FIG. 19). Here, the optical intensity of light of the pretransfer eraser 1017 is changed in the areas of photograph image in the document image and the areas of character image. Moreover, if it is decided that the multi-level/bi-level mode is set (YES at step S106), the bi-level/the multi-level mode processing is executed (step S107, refer to FIG. 20). Here, the optical intensity of light of the pretransfer eraser 1017 is changed according to the bi-level exposure method or to the multi-level exposure method. If it is decided that any of the above-mentioned modes is not set (NO at step S106), the sharpness mode processing is executed (step S108, refer to FIG. 24). Here, the intensity of light of the pretransfer eraser 1017 is changed according to whether the sharpness mode is set or not. After either step S105, S107 or S108 is executed, other processings are executed (step S109), and the flow returns to the key-input processing at step S102.

Figure 16A:
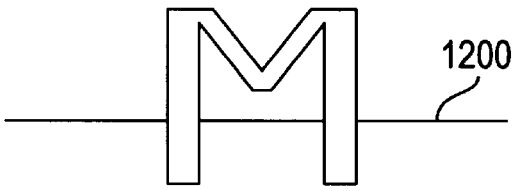
FIGS. 16A, 16B and 16C are diagrams of a character image in a document, a latent image thereof and toners adhered thereto.
Figure 16B:
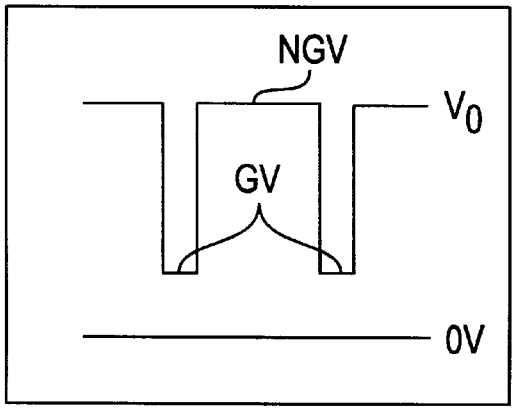
Figure 16C:
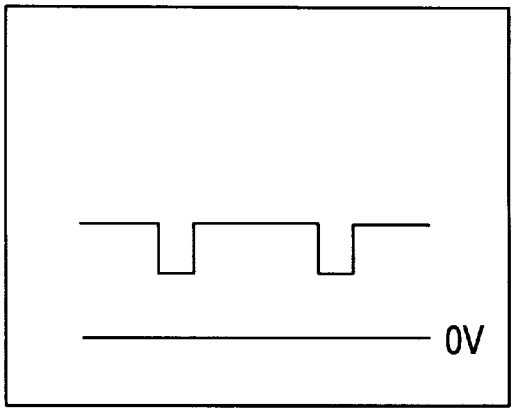

Next, the character/photograph mode (step S105 in FIG. 15) is explained. FIGS. 16A–16C and FIGS. 17A–17C show an electrostatic latent image formed on the photoconductor 1001 and the state of toner particles which adhere to the electrostatic latent image. FIGS. 16A–16C relate to a character image, while FIGS. 17A–17C relate to a photographic image. FIG. 16A shows "M" as an example of a character image and FIG. 16B shows the potential of an electrostatic latent image of "M" formed on the surface of photoconductor 1001 along a line 1200 in FIG. 16A. It is understood that the potential difference between a non-image area and an image area is large for the character image. As explained previously, when the potential difference between a non-image area and an image area is large, the above-mentioned phenomena such as discharge noises and inside omission are liable to happen. These phenomena can be suppressed by decreasing the potential NGV of the non-image area by the pretransfer eraser 1017 with light emission. On the other hand, when the amount of charges to be erased is large and the potential of the image area becomes larger than that of the non-image area, the linear image becomes bolder or the (toners are scattered). FIG. 16C shows a situation of the surface potential of the photoconductor 1001 when the pretransfer eraser 1017 emits light at an intensity of 0.5 mW/cm$^2$. It is understood that the potential NGV of the non-image area is a little higher than the potential GV of the image area, that is, that the potential difference between the non-image area and the image area is in the range of 0–200 V.

Figure 17A:
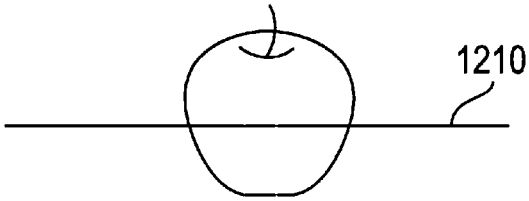
FIGS. 17A, 17B and 17C are diagrams of a photograph image in a document, a latent image thereof and toners adhered thereto.
Figure 17B:
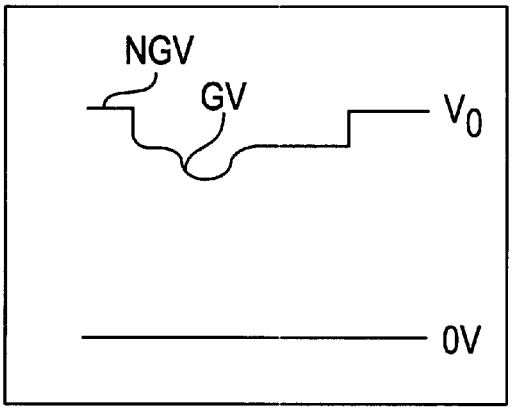
Figure 17C:
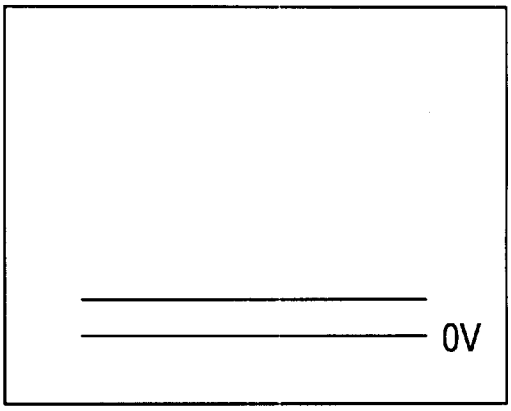

On the other hand, FIG. 17A shows an apple as an example of a photograph image. FIG. 17B shows the potential of the electrostatic latent image formed on the photoconductor 1001 along a line 1210 shown in FIG. 17A. When the multi-level exposure method is adopted as a gradation method, an image of a photograph or the like is expressed by the densities of the pixels. The potential difference between an image area and a non-image area is small, and a rapid change in potential is not likely to occur in an image area. Therefore, the inside omission is not likely to occur in contrast to a character image, and the necessity for pretransfer erasing by the pretransfer eraser 1017 is low. However, in a highlight image, where toners uniformly adhere to a small area of a relatively high potential, the discharge is liable to occur in a small gap near the transfer point, and this generates discharge noises. In this instance it is necessary to erase, by the pretransfer eraser 17, in order to suppress the discharge noises. As described above, in order to suppress discharge noises, it is desirable that the potential on the photoconductor 1001 is as low as possible, irrespective of the image area and the non-image area. On the other hand, if an optical intensity of erasing is high for a photograph image, toners may scatter; but the toner scattering is not noticeable in a photograph image. Then, the optical intensity of the pretransfer eraser 1017 is set higher for a photograph image than for a character image. FIG. 17C shows the surface potential of the photoconductor 1001 when the pretransfer eraser 1017 emits light at an intensity of 1.2 mW/cm$^2$. It is clear that the potentials GV and NGV of the image area and the non-image area become almost 0 V by the erasing.

Figure 18:
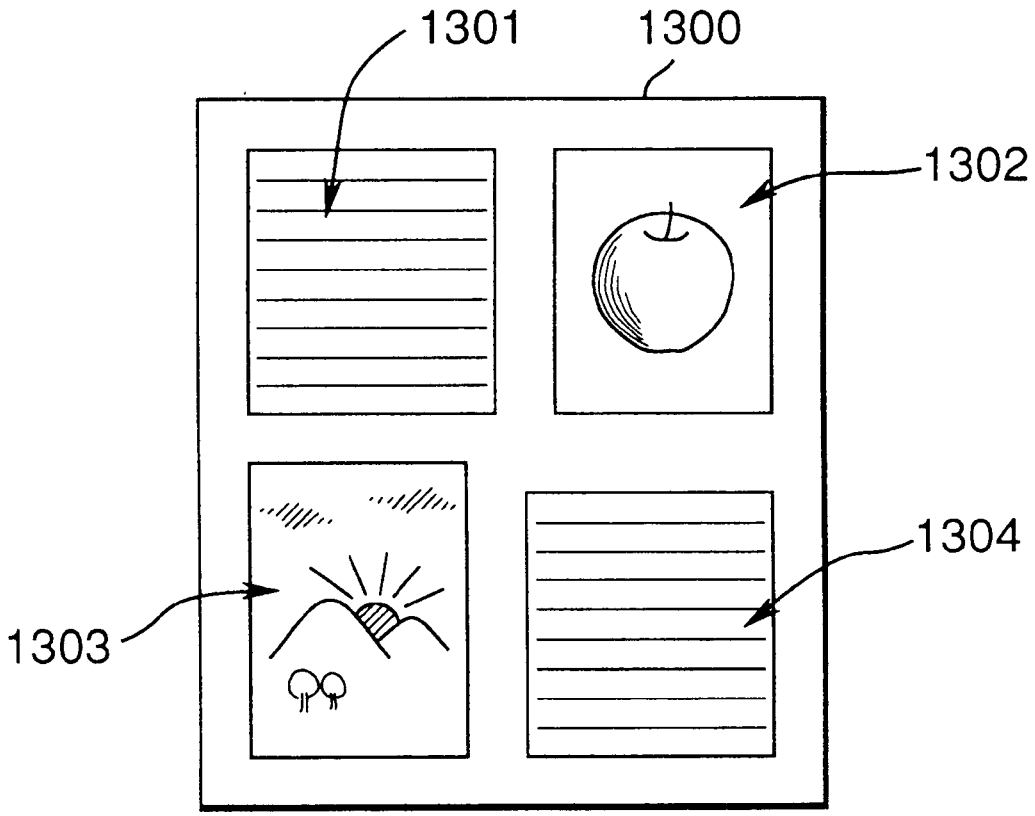
FIG. 18 is a diagram of a document including both character images and photograph images.

When the character/photograph mode is set by a user with the operational panel 1104, processing explained below is executed. FIG. 18 shows an example of a document 1300 where character images 1301 and 1304 and photograph images 1302 and 1303 are mixed. The intensity of light of the pretransfer eraser 1017 is set for the character areas 1301 and 1304 at an intensity of light (0.5 mW/cm$^2$), so that a difference between the potential GV of the image area and the potential NGV of the non-image area is within a predetermined range and the potential NGV of the non-image area does not become lower than the potential GV of the image area-image area. As a result, the discharge noises and the toner scattering are prevented for character areas. On the other hand, the intensity of light of the pretransfer eraser 1017 is set for the photograph areas 1302 and 1303 at an intensity of light (0.5 mW/cm$^2$), so that a difference between the potential GV of the image area and the potential NGV of the non-image area is within a predetermined range, and both potentials NGV of the non-image area and potential GV of the image area become about zero (refer to FIG. 10F). As a result, the discharge noises and the toner scattering of the photograph image is prevented in a highlight area in a photograph area.

Figure 19:
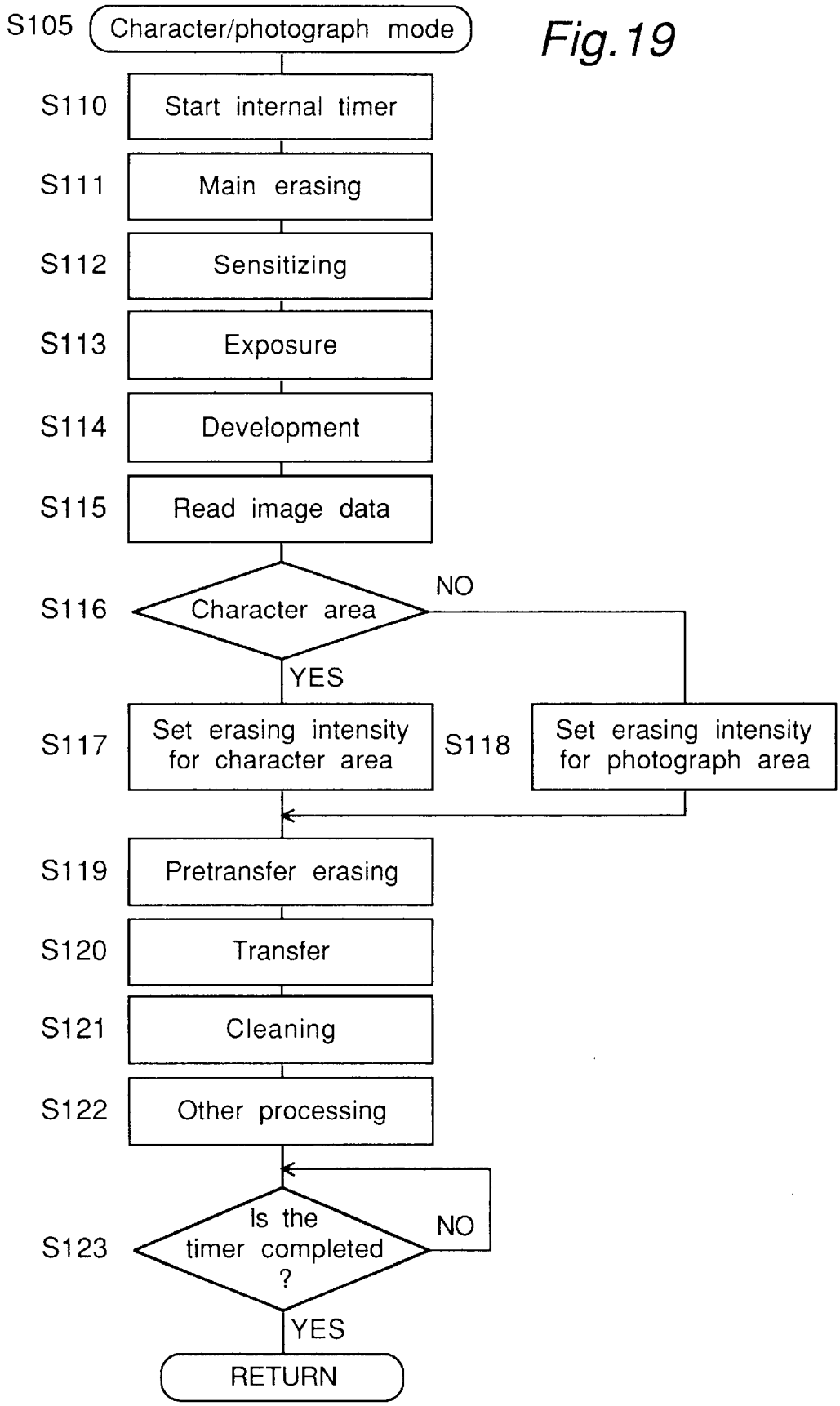
FIG. 19 is a flowchart of character/photograph mode processing.

FIG. 19 shows a flow of the character/photograph mode processing (FIG. 15, step S105). First, after an internal timer is started (step S110), the main eraser 1019 is driven to remove charges on the photoconductor 1001 completely (step S111), and the surface of photoconductor 1001 is sensitized uniformly with the sensitizing charger 1003 (step S112). The laser diode 1102 is driven according to image data to expose the surface of the photoconductor 1001 so that an electrostatic latent image is formed (step S113). Then, the developing unit 1005 is driven to adhere toners to the latent image on the surface of the photoconductor 1001 (step S114). Next, information on the results of image discrimination executed by the image signal processor 1101 is read from the RAM 106, and the type of image data is discriminated (step S115). For character areas (YES at step S116), the intensity of light of the pretransfer eraser 17 is set at 0.5 mW/cm$^2$ (step S117), while for a photograph area (NO at step S117), the intensity is set at 1.2 mW/cm$^2$ (step S118). Then, pretransfer erasing is performed according to the value set at step S117 or S118 (step S119). Next, the toner image is transferred onto a transfer paper 1015 (step S120). Residual toners are removed from the photoconductor 1001 (step S121), and other processings are executed (step S122). Then, after the internal timer is completed (YES at step S123), the flow returns to the main flow. For a document including only character images or photograph images, an appropriate intensity of light is set.

Figure 20A:
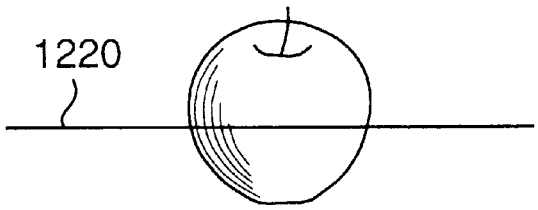
FIG. 20A is diagram of a half-tone image.
Figure 20B:
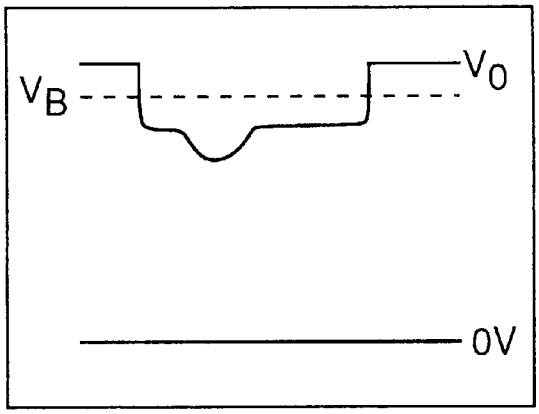
FIGS. 20B and 20C are diagrams of electrostatic latent images formed on the surface of the photoconductor by using multi-level exposure method and by using the bi-level exposing method.
Figure 20C:
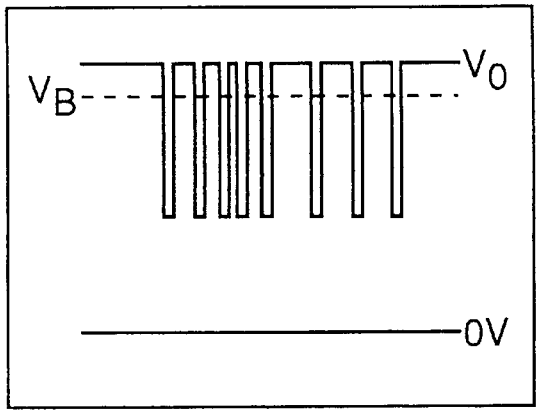

Next, the bi-level/multi-level mode (step S107 in FIG. 15) is explained. FIG. 20A shows an apple as an example of a photograph image. FIG. 20B shows the potential of an electrostatic latent image thereof formed on the photoconductor 1001 along a line 1220 in FIG. 20A when the multi-level exposure method is adopted, while FIG. 20C shows an electrostatic latent image on the photoconductor 1001 along the line 1220 when the bi-level exposure method is adopted. As shown in FIG. 20B, when the multi-level exposure method is used, the potential changes continuously in the latent image. On the other hand as shown in FIG. 20C, when the bi-level exposure method is used, portions where the potential drops sharply exist intermittently, and the density of the portions is small in an area having low densities and large in an area having high densities. Thus, the potential difference between the non-image areas and the portions where the potential becomes low becomes wider than in a latent image obtained by the multi-level reproduction.

As explained above, when a two-component developing material comprising toners and carriers is used, carriers tend to be adhered to the photoconductor as the potential difference between the potential NGV of the non-image area and the developing bias potential $V_B$ applied to the developing sleeve of the developing device increases. Further, even when the potential difference is the same, if many edges exist in a latent image, as observed when the bi-level exposure method is used, carriers tend to be adhered to the photoconductor due to so-called edge effect.

Figure 21:
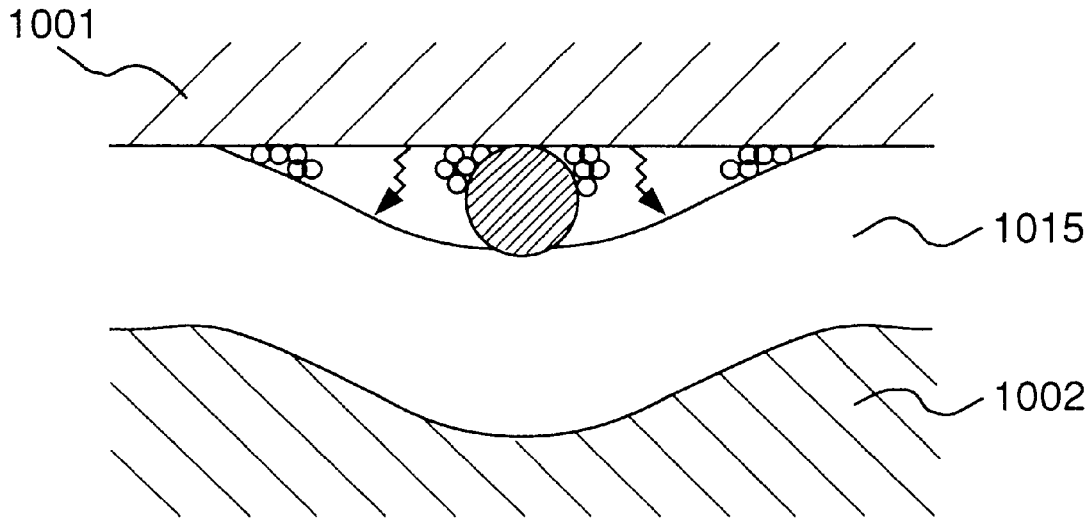
FIG. 21 is a schematic diagram on a state in the transfer point where an electrostatic latent image is developed with toners while including adhered carriers when the bi-level exposing method is used.

FIG. 21 shows a situation at a transfer point schematically where toners develop a latent image while carriers are also adhered to the photoconductor. In FIG. 21 an open circle denotes a toner grain, while a large hatched circle denotes a carrier grain. In general, the size of a carrier is several times larger than that of a toner. In the two-component developing material used in this embodiment, an average grain size of toner is 8 $\mu$m, while that of a carrier is 40 $\mu$m. When a carrier adheres to the photoconductor 1001, a large space is generated between the photoconductor 1001 and a transfer material 1015 on the transfer belt 1002. In the space, gaseous discharge occurs under a high transfer electric field, and negative charges are injected from the photoconductor 1001 to the transfer material 1015. In a portion where negative charges are injected, coulomb force is weakened, and toners become harder to be adhered. As a result, an image has a white portion in an image. In order to prevent carrier adhesion, when the bi-level exposure method is adopted, the intensity of light of the pretransfer eraser 1017 is set at a value larger than that set for the multi-level exposure method.

When a user sets the bi-level exposure method with bi-level/multi-level mode key 1164 with the operational panel 1104, the intensity of light of the pretransfer eraser 1017 is set at a value larger than that set for the multi-level exposure method, but in a predetermined range of the difference between the potential of the non-negative area and that of the image area. In this embodiment, the intensity of light of the pretransfer eraser 1017 is set at 0.5 mW/cm$_2$ for multi-level exposure method, and at 2.5 mW/cm$_2$ for bi-level exposure method. As a result carrier adhesion can be prevented even when bi-level exposure method is adopted.

Figure 22:
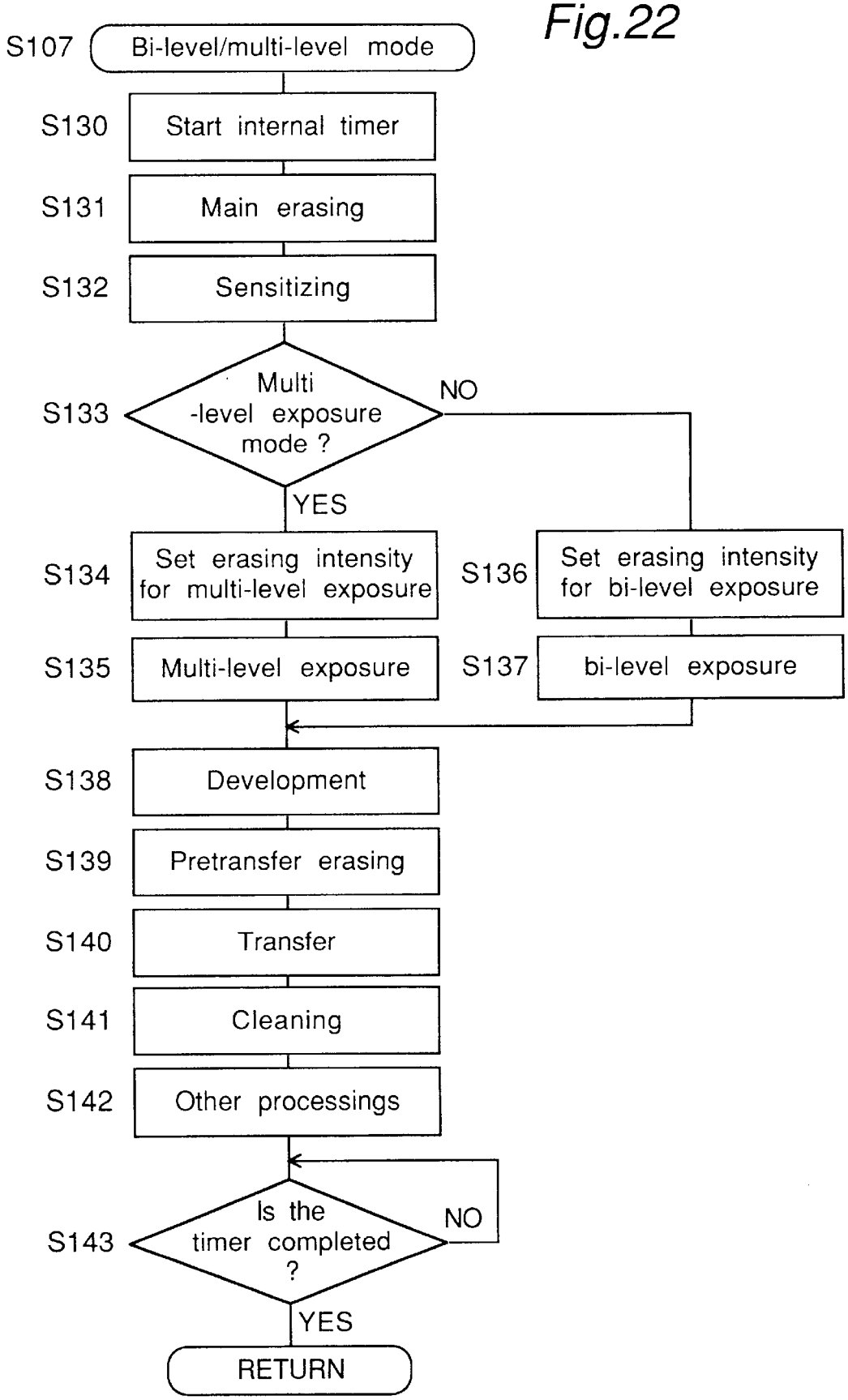
FIG. 22 is a flowchart of bi-level/the multi-level mode processing.

FIG. 22 shows a flow of bi-level/multi-level processing (step 107 in FIG. 15). After an internal timer is started (step S130), the main eraser 1019 is driven for exposure to remove the surface potential of the photoconductor 1001 completely (step S131), and the surface of the photoconductor 1001 is sensitized uniformly by the sensitizing charger 1003 (step S132). Then, when the multi-level exposure method is set (YES at step S133), the intensity of light emission of the pretransfer eraser 1017 is set at the value 0.5 mW/cm$^2$ (step S134), and the photoconductor 1001 is exposed according to the image data with the multi-level exposure method (step S135). On the other hand, when the bi-level exposure method is set (NO at step S133), the intensity of light emission of the pretransfer eraser 1017 is set at the value 2.5 mW/cm$^2$ (step S136), and the photoconductor 1001 is exposed according to the image data with the bi-level exposure method (step S137). Then, a selected developing device 1005 is driven to develop a latent image with toners to form a toner image (step S138). Next, the pretransfer eraser 1017 is set at the value set at step S134 or S136 to remove charges from the photoconductor 1001 (step S139). Then, the toner image is transferred onto a transfer paper (step S140). Next, residual toners are cleaned from the photoconductor 1001 (step S141), and other processings are executed (step S142). After the internal timer completed or counted up (YES at step S143), the flow returns to the main flow.

Figure 23A:
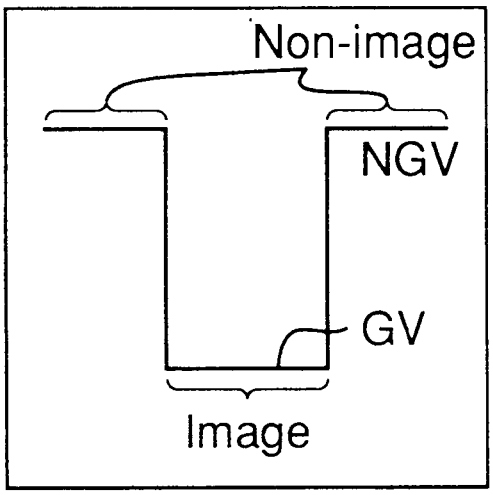
FIGS. 23A and 23B are diagrams of latent images on the photoconductor in an usual mode and in sharpness mode.
Figure 23B:
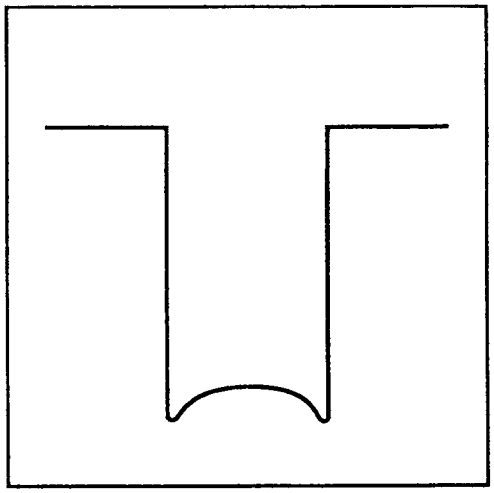

Next, the sharpness mode is explained. In sharpness mode, image processing is performed so that density difference is emphasized as compared to the normal mode, and an electrostatic latent image is formed according to image data subjected to the above-mentioned processing. Latent images on the photoconductor in a normal mode and in the sharpness mode are compared in FIGS. 23A and 23B. FIG. 23A shows the potential of a latent image for a linear image in a normal mode, while FIG. 23B shows the potential for the same image in the sharpness mode. By comparing FIGS. 23A and 23B, it is understood that attenuation of the potential at edge portions of the linear image is larger in the sharpness mode than in the normal mode. Because the sharpness mode is applied mainly to a linear image, it is required to suppress any narrowing of linear image, scattering of toners, and missing inside in order to reproduce a good image. On the other hand, for a half-tone image such as a photograph image, a suppression of discharge noises is needed more than prevention of toner scattering. In this instance when the sharpness mode is set, the intensity of light emission of the pretransfer eraser 1017 is set at a value 0.5 mW/cm$^2$ so that the potential at the non-image area NGV is somewhat larger than that at the image area GV and so that the difference between the two potentials is in a predetermined range. Thus, toner scattering is prevented in edge emphasis in the sharpness mode. When the sharpness mode is not set, the intensity of light emission of the pretransfer eraser 1017 is set at another value 2.5 mW/cm$^2$ to remove charges on the photoconductor 1001 sufficiently in order to prevent discharge noises.

Figure 24:
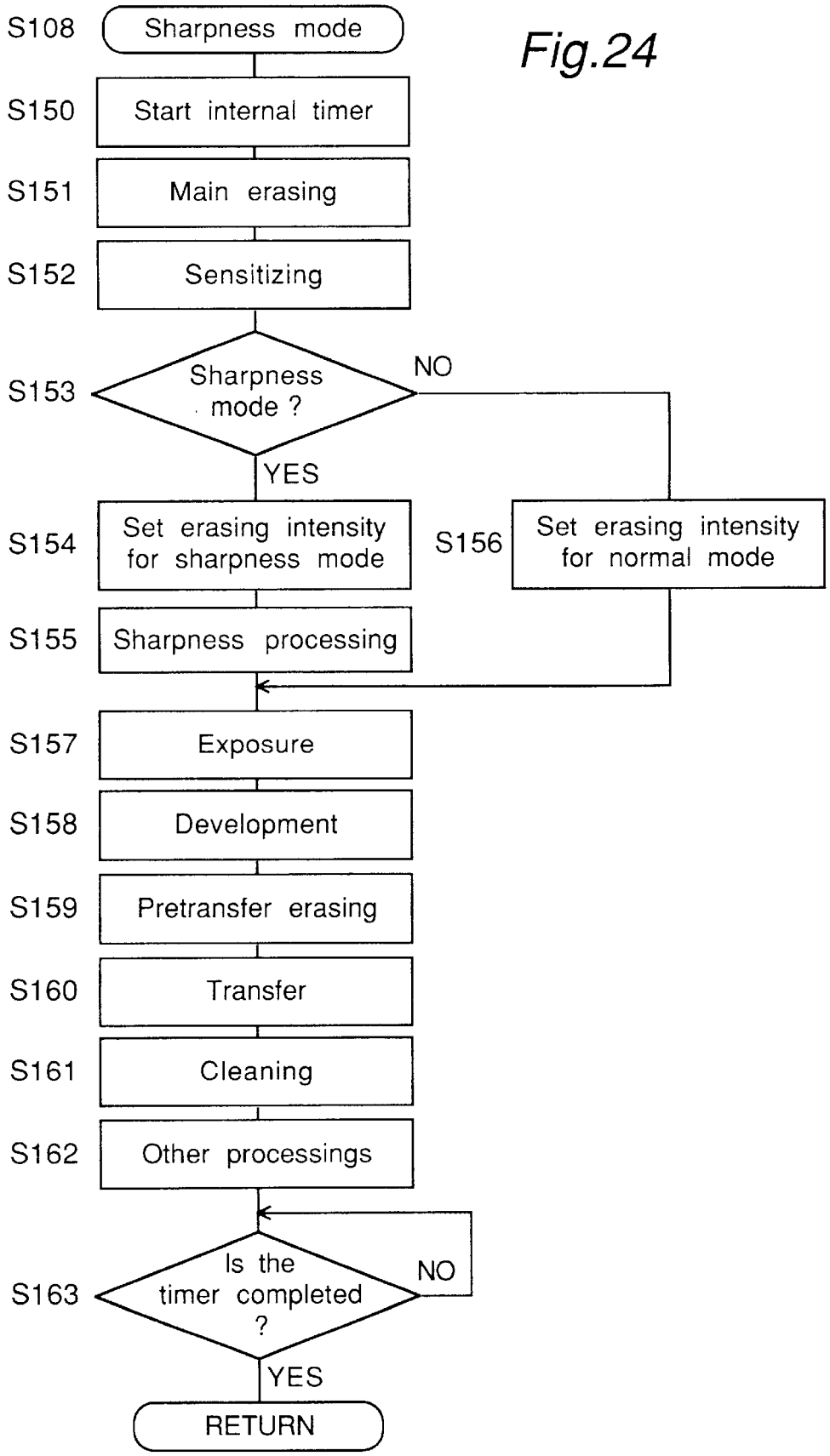
FIG. 24 is a flowchart of sharpness mode processing.

FIG. 24 shows a flow of the sharpness mode processing (step S108 in FIG. 15). After an internal timer is started (step S150), the main eraser 1019 is driven for exposure to completely remove the surface potential of the photoconductor 1001 (step S151), and the surface of the photoconductor 1001 is sensitized uniformly by the sensitizing charger 1003 (step S152). Then, when the sharpness mode is set (YES at step S153), the intensity of light emission of the pretransfer eraser 1017 is set at the value 0.5 mW/cm$^2$ for sharpness mode (step S154), and the image data are subjected to processing for edge emphasis in the sharpness mode (step S155). On the other hand, when the sharpness mode is not set (NO at step S153), the intensity of light emission of the pretransfer eraser 1017 is set at the value 2.5 mW/cm$^2$ (step S156). Then, the photoconductor 1001 is exposed according to the image data (step S157). Then, a selected developing device 1005 is driven to develop a latent image with toners to form a toner image (step S158). Next, the pretransfer eraser 1017 is driven at the value set at step S154 or S156 to remove charges from the photoconductor 1001 (step S159). Then, the toner image is transferred onto a transfer paper (step S160). Next, residual toners are cleaned from the photoconductor 1001 (step S161), and other processings are executed (step S162). After the internal timer is completed or counted up (YES at step S163), the flow returns to the main flow.

In this embodiment, the intensities of light emission of the pretransfer eraser 1015 are stored in the ROM 105. However, the intensity may be set at an appropriate value according to a bi-level or multi-level exposure method and the type of image.

Further, in this embodiment, a type of image in various areas in a document is discriminated automatically by the image signal processor 1101. However, the area may be set by a user by setting the coordinates in a document.

In the above-mentioned second embodiment, pretransfer erasing is performed appropriately for various types of images in a document image. In this manner, image quality transferred onto a transfer material can be improved. Further, because the degree of removing charges on the photoconductor is set appropriately, discharge noises and toner scattering can be prevented.

Figure 25:
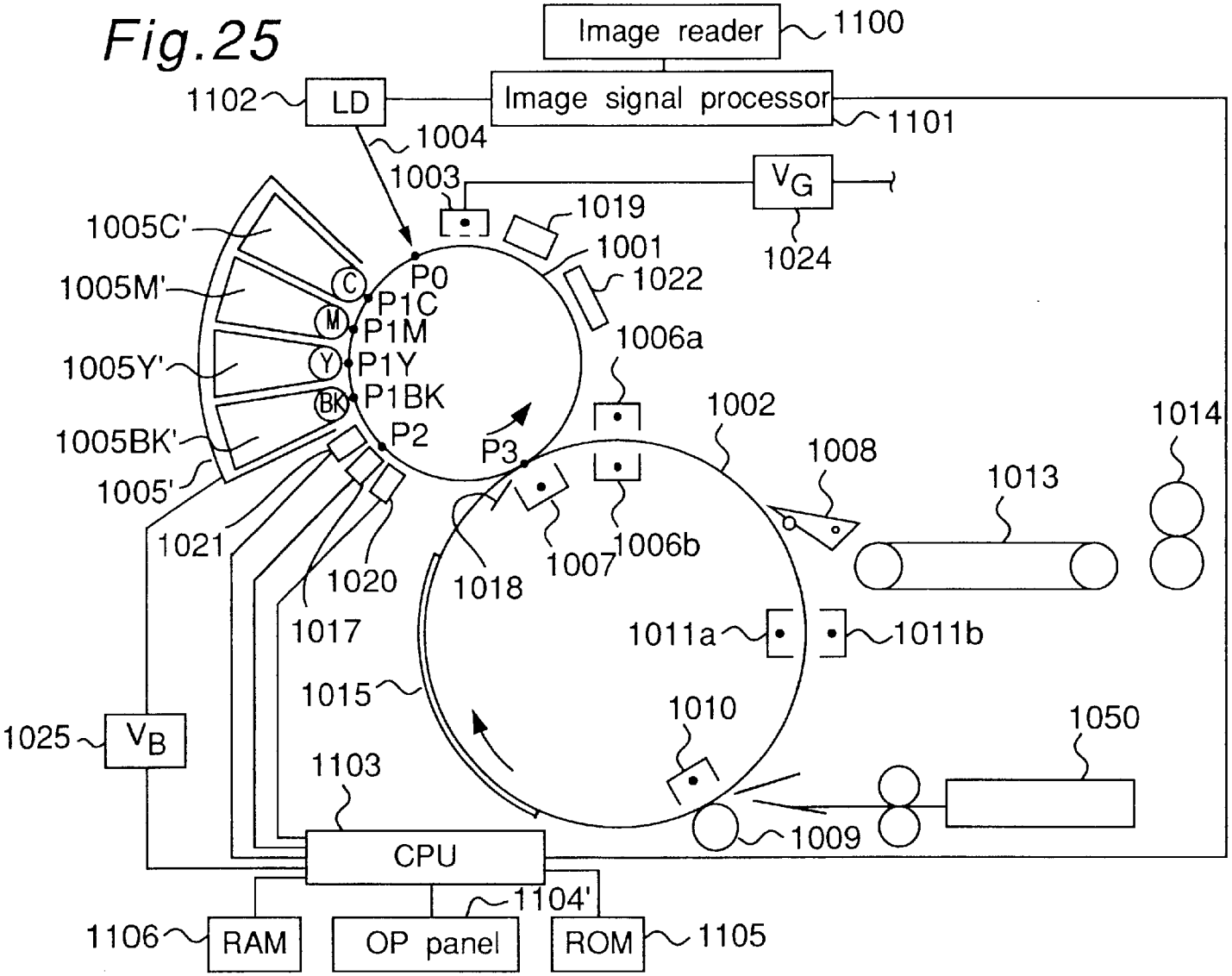
FIG. 25 is a schematic sectional view of a digital full color copying machine of a third embodiment.

Next, a digital full color copying machine of a third embodiment of the invention is explained. FIG. 25 shows the digital full color copying machine schematically. This copying machine is the same as that of the second embodiment shown in FIG. 7 except that a potential sensor 1020 and a sensor 1021 for optically detecting an amount of adhered toners are provided near the pretransfer eraser 1017, and that, developing unit 1005' of a different type is used for developing. The potential sensor 1020 for detecting the surface potential of the photoconductor 1001 is arranged between the pretransfer eraser 1017 and the transfer point P3. The sensor 1021 for detecting an amount of adhered toners optically (hereinafter referred to as AIDC sensor) is arranged between the developing unit 1005' and the pretransfer eraser 1017. These sensors 1020 and 1021 are used for first and second modes to be explained later. The developing unit 1005' comprises a first developing device 1005C' for cyan, a second one 1005M' for magenta, a third one 1005Y' for yellow and a fourth one 1005BK' for black, and the developing devices are arranged successively along the rotation direction of the photoconductor 1001 at developing points P1C', P1M', P1Y' and P1BK'. One of the developing devices is selected successively to develop the toner image with toners at the developing point P1C', P1M', P1Y' or P1BK'.

With reference to the developing unit 1005', the decay of the potential NGV of the non-image area and that GV of the image area is explained. As shown in FIG. 25, the four developing devices 1005C', 1005M', 1005Y' and 1005BK' are arranged successively along the photoconductor 1001. The characteristics of toners of the four colors are adjusted to be the same. As shown in FIGS. 9A–9C, the potential NGV of the non-image area and the potential GV of the image area are attenuated to zero V as the photoconductor 1001 is rotated. Therefore, the photoconductor 1001 is sensitized at the grid potential $V_G$ by the sensitizing charger 1003, and the potentials NGV and GV become different at developing points P1C', P1M', P1Y' and P1BK' for the developing devices 1005C', 1005M', 1005Y' and 1005BK'.

In order to keep the amount of adhered toners constant for the same image, the grid potential $V_G$ of the sensitizing charger 1003 and the intensity of light emission of the laser diode 1102 are set so that the potentials NGV and GV of the photoconductor 1001 are the same at the developing points P1C', P1M', P1Y' and P1BK'. Thus, the potentials NGV and GV of the photoconductor 1001 become different at transfer point P3 according to the developing device activated.

Figure 26A:
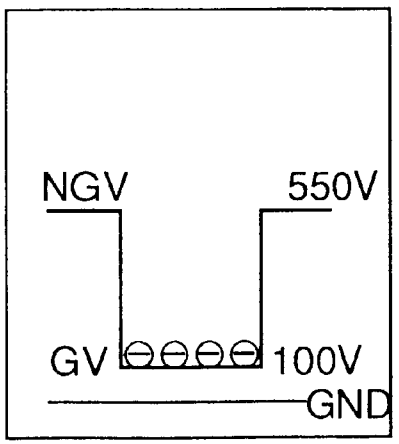
FIGS. 26A, 26B, 26C and 26D are diagrams of the potential NGV of a non-image area and the potential GV of an image area at point P2 when the grid potential $V_G$ and the intensity of light emission of the laser diode are set so that the potential NGV becomes 750 V and the potential GV becomes 150 V at the developing device.
Figure 26B:
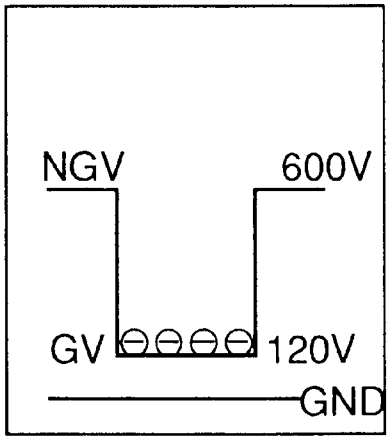
Figure 26C:
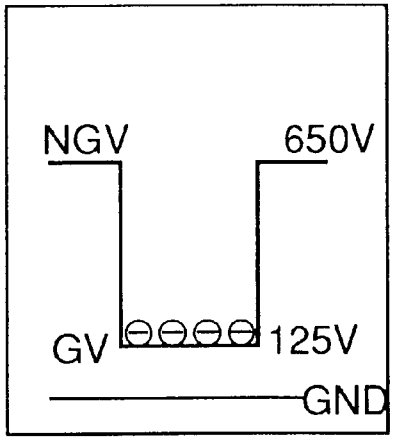
Figure 26D:
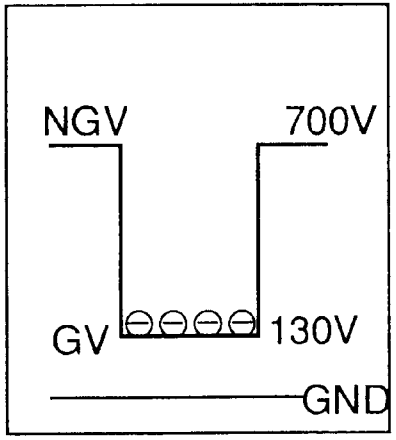

FIGS. 26A, 26B, 26C and 26D show the potential NGV of the non-image area and the potential GV of the image area when the grid potential $V_G$ of the sensitizing charger 1003 and the intensity of light emission of the laser diode 1102 are set so that the potentials NGV and GV of the photoconductor 1001 are 750 V and 150 V at the developing points P1C', P1M', P1Y' and P1BK'. For example, when the developing device 1005C' for cyan is used, developing is performed at point P1C', which is the farthest from the pretransfer eraser 1017 among the developing points. In this case, as shown in FIG. 26A, the potentials NGV and GV of the photoconductor 1001 become 550 V and 100 V. On the other hand, when the developing device 1005BK' for black is used, developing is performed at point P1BK', which is the nearest to the pretransfer eraser 1017 among the developing points. In this case, as shown in FIG. 26D, the potentials NGV and GV of the photoconductor 1001 become 700 V and 130 V. Thus, the potential change is smaller for cyan developing. In the situation shown in FIGS. 26A–26D, the intensity of light emission of the pretransfer eraser 1017 is set at 0.69 mW/cm$^2$ for cyan developing, at 0.66 mW/cm$^2$ for magenta developing, at 0.64 mW/cm$^2$ for yellow developing and at 0.62 mW/cm$^2$ for black developing in order to set the difference between the potentials NGV and GV at the best value of 50 V. As explained above, the intensity of light emission of the pretransfer eraser is set appropriately according to each of the developing devices.

Figure 27:
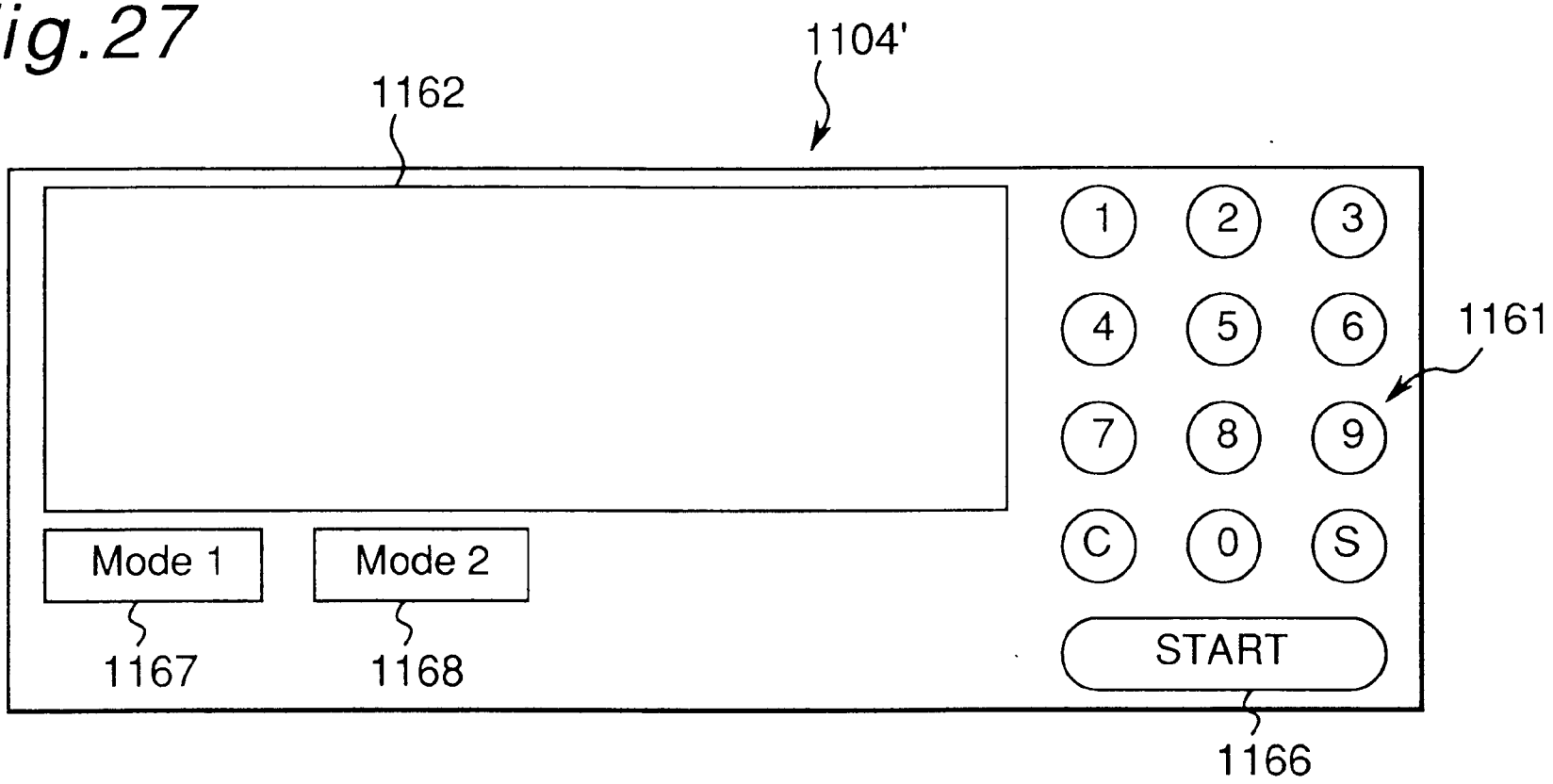
FIG. 27 is an elevational view of an operation panel.

FIG. 27 shows an operational panel 1104' of the embodiment. The operational panel 1104' comprises a display 1162 for displaying copy conditions, mode set keys 1167 and 1168, ten-keys 1161 for setting a number of copies, and a start key 1166 for starting copy operation. The mode key 1167 is provided to set the first mode and the other mode key 1166 is provided to set the second mode.

In this embodiment, the two modes of control of the pretransfer eraser 1017 can be performed, and in each mode, the pretransfer erasing is controlled according to the position of the developing device to compensate the difference in the amount of charges to be removed according to the difference in developing points. In the first mode, the change in developing potential due to humidity and temperature around the photoconductor 1001 and the like is compensated. In the second mode, the change in photosensitive characteristic of the photoconductor 1001 is compensated.

Figure 28:
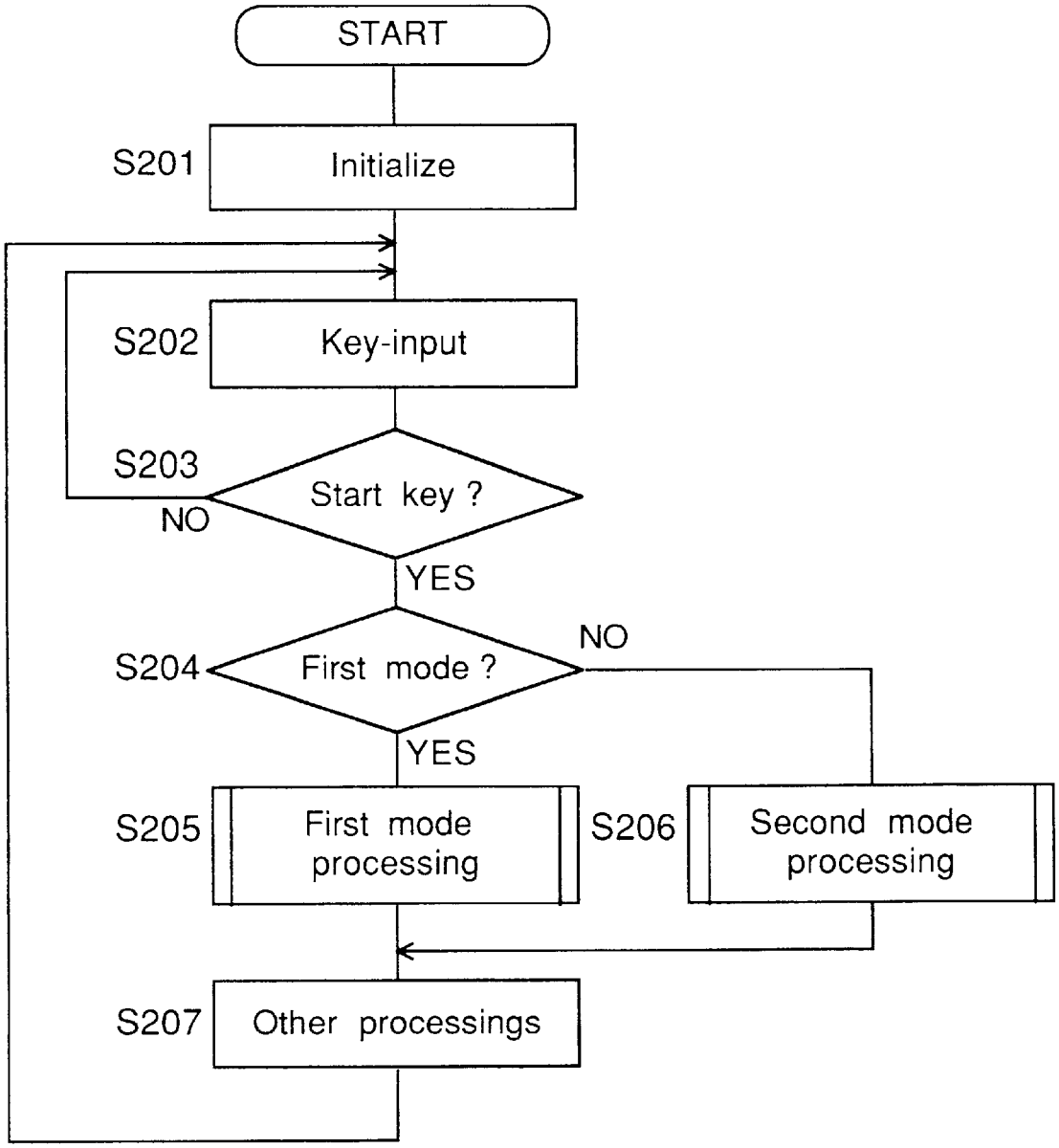
FIG. 28 is a flowchart of the copy operation of the digital color copying machine.

FIG. 28 shows a main flow of the CPU 1103. First, after the copying machine is initialized (step S201), a key-input of mode by a user is accepted (step S202) until the start key 1166 is pressed (YES at step S203). Next, if a key-input of first mode key 1167 has been pressed (YES at step S204), first mode processing is performed (step S205, refer to FIG. 32). On the other hand, if a key-input of second mode key 1168 has been pressed (NO at step S204), second mode processing is performed (step S206, refer to FIG. 33). Then, other processings are performed (step S207), and the flow returns to step S202.

Next, the first mode is explained. The amount of charges of toners are changed according to changes in humidity and temperature in the copying machine and the like. As a result, even if the developing bias potential $V_B$ of the developing sleeve of the developing devices 1005C', 1005M', 1005Y' and 1005BK' is the same, the amount of adhered toners on the photoconductor 1001 is changed. In the first mode, the change in developing efficiency is detected by the AIDC sensor 1021, which measures a density of adhered toners of a standard pattern formed on the photoconductor. Then, the developing bias potential $V_B$ is set to have the desired value of the detected density by the AIDC sensor 1021, while the grid potential $V_G$ of the sensitizing charger 1003 is set according to the detected change in developing efficiency, and the intensity of light emission of the transfer eraser 1017 is controlled according to the grid potential $V_G$. Thus, in the first mode, the pretransfer erasing can be performed appropriately according to the change in developing efficiency of the photoconductor 1001.

Figure 29:
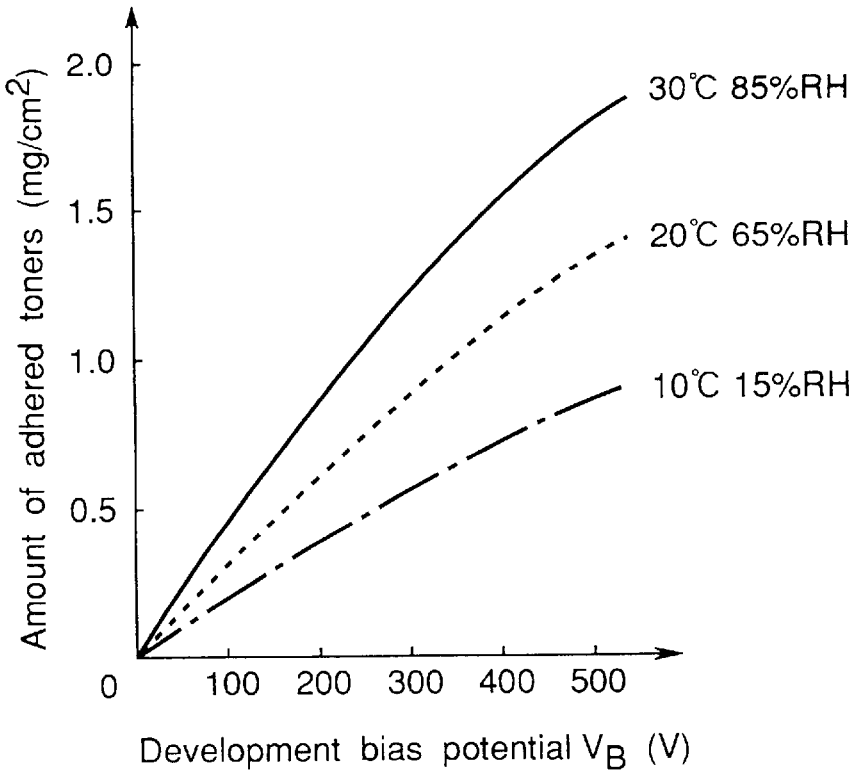
FIG. 29 is a graph of a relation of the potential of the developing bias potential to the amount of the adhered toners ($mg/cm^2$) under various environments.
Figure 30:
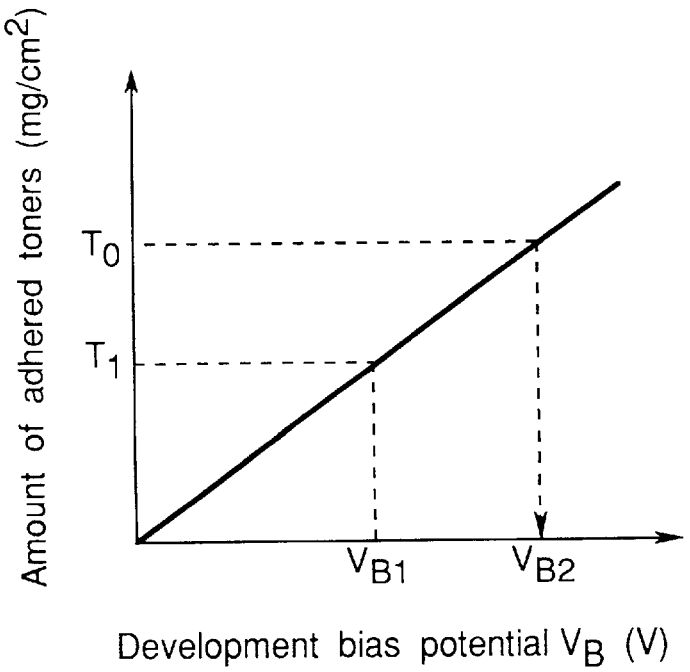
FIG. 30 is a graph of a relation of the amount of adhered toners ($mg/cm^2$) to developing bias potential.

FIG. 29 shows a relation of the amount of toners (mg/cm$^2$) adhered to the photoconductor 1001 plotted against developing bias potential $V_B$ (V) under various environment conditions. A solid line shows a relation at 30° C. and 85% RH, a dashed line shows a relation at 20° C. and 65% RH, and a dot and dashed line shows a relation at 10° C. and 15% RH. The amount of toners adhered to the photoconductor 1001 is regarded to have a linear relation to the developing bias potential $V_B$ with a starting point at the origin of the graph. Then, as shown in FIG. 30, the developing bias potential $V_{B2}$ needed for the amount of toners $T_0$ adhered to the photoconductor 1001 can be calculated from the linearity relation from the measured amount of toners $T_1$ for the developing bias potential $V_{B1}$. When the developing bias potential $V_B$ is set, the grid potential $V_G$ of the sensitizing charger 1003 is also changed according to the developing bias potential $V_B$ in order to keep the difference between the potential NGV at the non-image area and the potential GV at the image area within a predetermined range. If the difference is smaller than the range, a fog may happen, while if the difference is larger than the range, carriers are adhered. When the grid potential $V_G$ of the sensitizing charger 1003 is changed, the surface potential of the photoconductor 1001 is changed, and the amount of charged removed by the pretransfer eraser 1017 is changed even if the same intensity of light is used. Then, the intensity of the pretransfer eraser 1017 is also changed according to the grid potential $V_G$.

Figure 31:
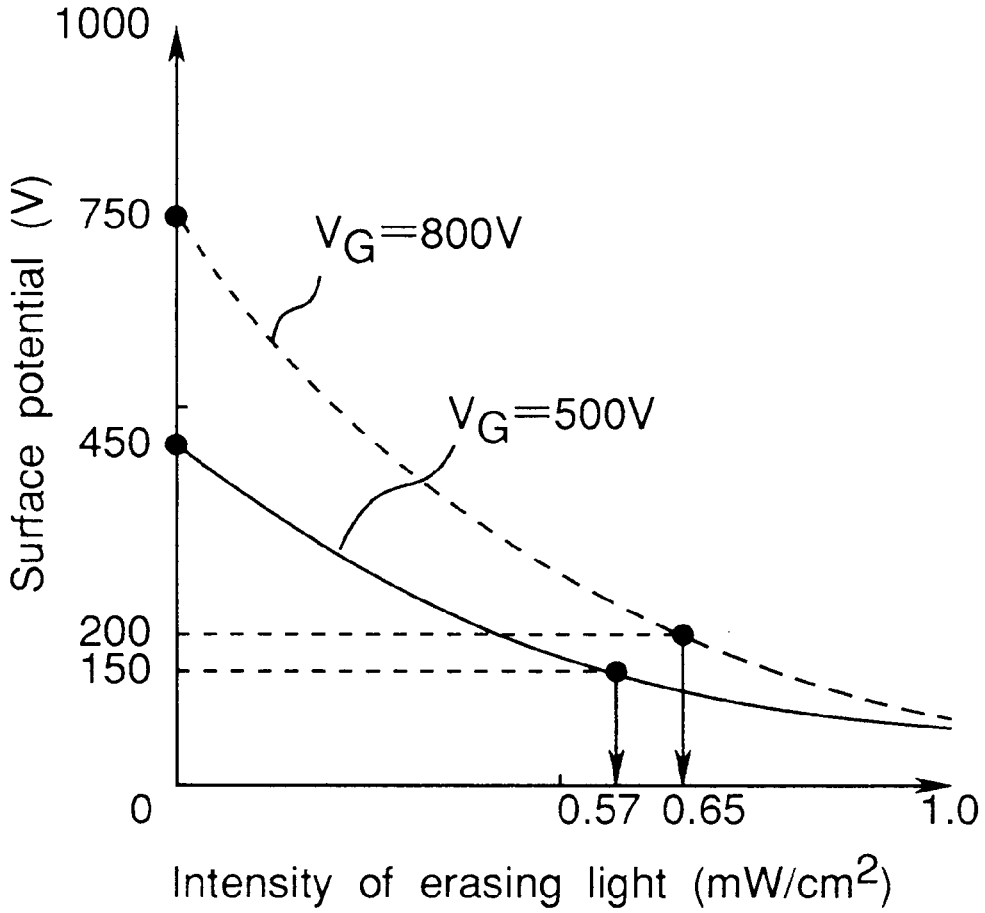
FIG. 31 is a graph of a relation of the intensity of the pretransfer eraser ($mW/cm^2$) to the surface potential $V_0$ on the photoconductor just before pretransfer discharging when the grid potential VG is set at 500 V and at 800 V.

Next, the correction of the intensity of the pretransfer eraser 1017 is explained. FIG. 31 shows a relation of the surface potential $V_0$ of the photoconductor just before pretransfer erasing plotted against intensity of light (mW/cm$^2$) of the pretransfer eraser 1017 when the grid potential $V_G$ is set at 800 V and at 500 V. When the grid potential $V_G$ is set, for example, at 500 V, the surface potential of the photoconductor 1001 becomes about 500 V. The data ROM 105 stores the relations of the surface potential $V_0$ of the photoconductor just before pretransfer erasing plotted against the intensity of light (mW/cm$^2$) of the pretransfer eraser 1017, when the grid potential $V_G$ is set at 800 V, at 600 V, at 700 V and at 500 V. If the relations are stored in detail, for example, for grid potentials $V_G$ changed in the unit of say 10 V, the pretransfer erasing can be controlled more precisely.

The surface electric potential $V_0$ decreases according to the rotation of the photoconductor 1001. The surface electric potential $V_0$ of the photoconductor 1001, that is, the electric potential NGV of the non-image area, decreases to about 450 V just before discharging with the pretransfer eraser 1017. On the other hand, the electric potential GV of the image area exposed with the laser diode 1102 at 0.8 mW/cm$^2$ becomes about 100 V just before discharging with the pretransfer eraser 1017. A solid line in FIG. 31 shows a relation of the surface electric potential $V_0$ of the photoconductor 1001 to the intensity of light emission (mW/cm$^2$) when the surface electric potential $V_0$ of the photoconductor 1001 is 450 V just before discharging with the pretransfer eraser 1017. This graph shows that the intensity of light emission of the pretransfer eraser 1017 is set at 0.57 mW/cm$^2$ in order to decrease the electric potential NGV of a non-image area down to 150 V, which is about 50 V higher than the electric potential $G_v$ of the image area. When the grid electric potential $V_G$ is set at 800 V, the surface electric potential $V_0$ of the photoconductor 1001, that is, the potential NGV of a non-image area, is about 750 V. The surface electric potential $V_0$ becomes smaller as the photoconductor 1001 is rotated. The surface electric potential $V_0$, that is, the electric potential NGV of a non-image area, of the photoconductor 1001 decreases to about 750 V just before discharging with the pretransfer eraser 1017. On the other hand, the electric potential $G_v$ of the image area exposed with laser diode 102 at 0.8 mW/cm$^2$ becomes about 150 V just before discharging with the pretransfer eraser 1017. Moreover, a dot line in FIG. 31 shows a relation of the surface electric potential $V_0$ of the photoconductor 1001 to the intensity of light emission (mW/cm$^2$) of the pretransfer eraser 1017 when the surface electric potential $V_0$ of the photoconductor 1001 is 750 V just before discharging with the pretransfer eraser 1017. The graph shows that the intensity of light emission of the pretransfer eraser 1017 is set at 0.65 mW/cm$^2$ in order to decrease the electric potential NGV of a non-image area down to 200 V which is about 50 V higher than the electric potential GV of the image area.

More accurately, it is necessary to explain the electric potential at the transfer point P3. However, the electric potentials NGV and GV decrease only a little by the dark decay and the like to the transfer point P3 after discharging with the pretransfer eraser 1017. Then, the electric potential at the position for pretransfer erasing is discussed above.

Figure 32:
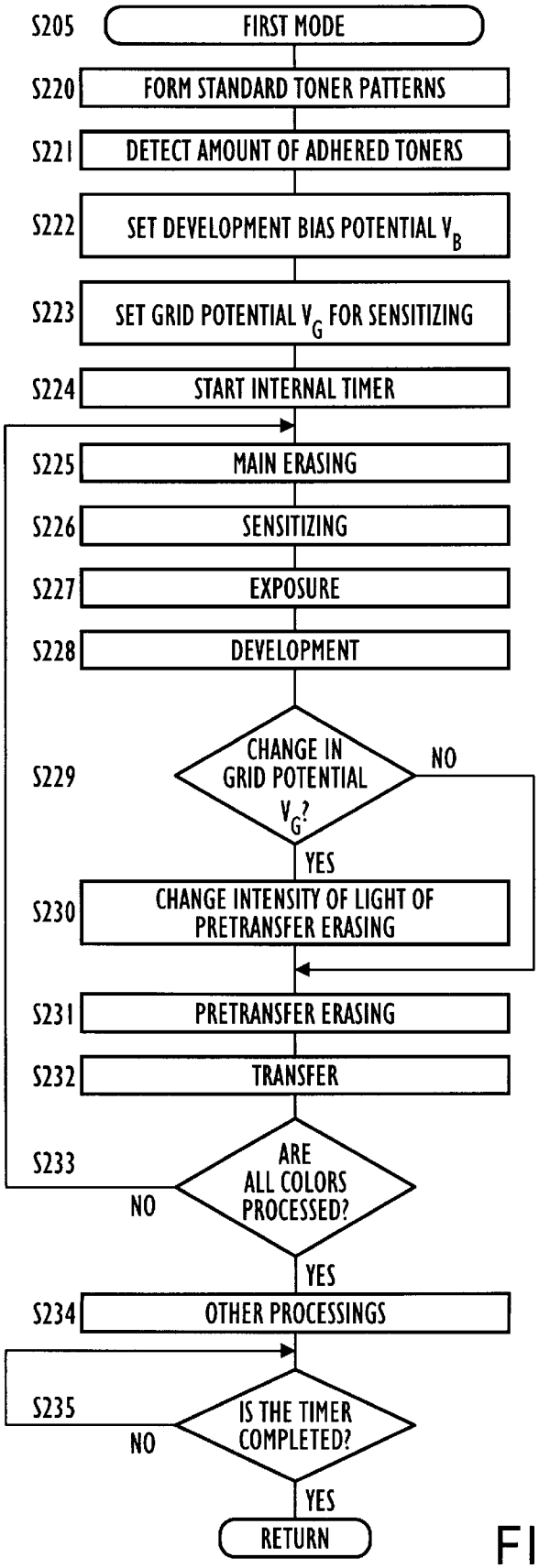
FIG. 32 is a flowchart of first mode processing.

FIG. 32 shows a flow of the first mode processing (step S205 in FIG. 28). First, standard patterns are formed on the photoconductor 1001 (step S220). Next, the amount of the toners adhered to the standard patterns is measured with the AIDC sensor 1021. Then, the developing bias electric potential $V_B$ is set to adhere a desired amount of toners according to the relation between the measured value of the adhered toners and the developing bias electric potential $V_B$ (step S222), and the grid electric potential $V_G$ is set according to the developing bias electric potential $V_B$ (step S223). Next, an internal timer is started (step S224).

Next, the photoconductor 1001 is discharged with the main eraser 1019 (step S225). Then, the sensitizing charger 1003 is driven to charge the surface of the photoconductor 1001 uniformly at the grid electric potential $V_G$ set at step S223 (step S226). Next, the laser diode 1102 emits light according to the image data of a document to form an electrostatic latent image on the photoconductor 1001 (step S227). One of developing devices is selected, and toners are adhered onto the electrostatic latent image to form a toner image (step S228). The developing device is selected in the order of the developing devices 1005C', 1005M', 1005Y' and 1005BK' for cyan, magenta, yellow and black. If the value of the grid electric potential $V_G$ is changed at step S223 (YES at step S229), the intensity of light emission of the pretransfer eraser 1017 is set according to the grid electric potential $V_G$ (step S230). The difference in developing point is also taken into account. Then, the pretransfer erasing is performed at the intensity of light emission (step S231). If the grid electric potential $V_G$ is not changed at step S223 (NO at step S229), the pretransfer erasing is performed at the intensity of light emission used last time. Next, the toner image formed on the photoconductor 1001 is transferred onto a paper supplied from the cassette 1050 (step S232). The flow returns to step S225 if all the colors of cyan, magenta, yellow and black are not printed (NO at step S233). If the print of all of the four colors completes (YES at step S233), other processings such as the removal of residual toners on the photoconductor 1001 are performed (step S234), and after the internal timer counts up (YES at step S235), the flow returns to the main flow.

Next, the second mode is explained. In the second mode, the pretransfer erasing is performed appropriately in correspondence to the change in the photosensitive characteristics of the photoconductor 1001, such as secular change. Two surface potentials of the photoconductor 1001 are compared. The first surface potential is measured when the photoconductor 1001 is exposed at the predetermined optical intensity of the laser after sensitized at the predetermined grid electric potential $V_G$ and exposed to pretransfer erasing. The second surface electric potential of the photoconductor 1001 is measured when the photoconductor 1001 is not exposed at the predetermined optical intensity of the laser after sensitized at the predetermined grid electric potential $V_G$ and exposed to pretransfer erasing. Then, if the difference between the two values is different from that obtained last time, the optical intensity of the pretransfer eraser 1017 is corrected appropriately.

Figure 33:
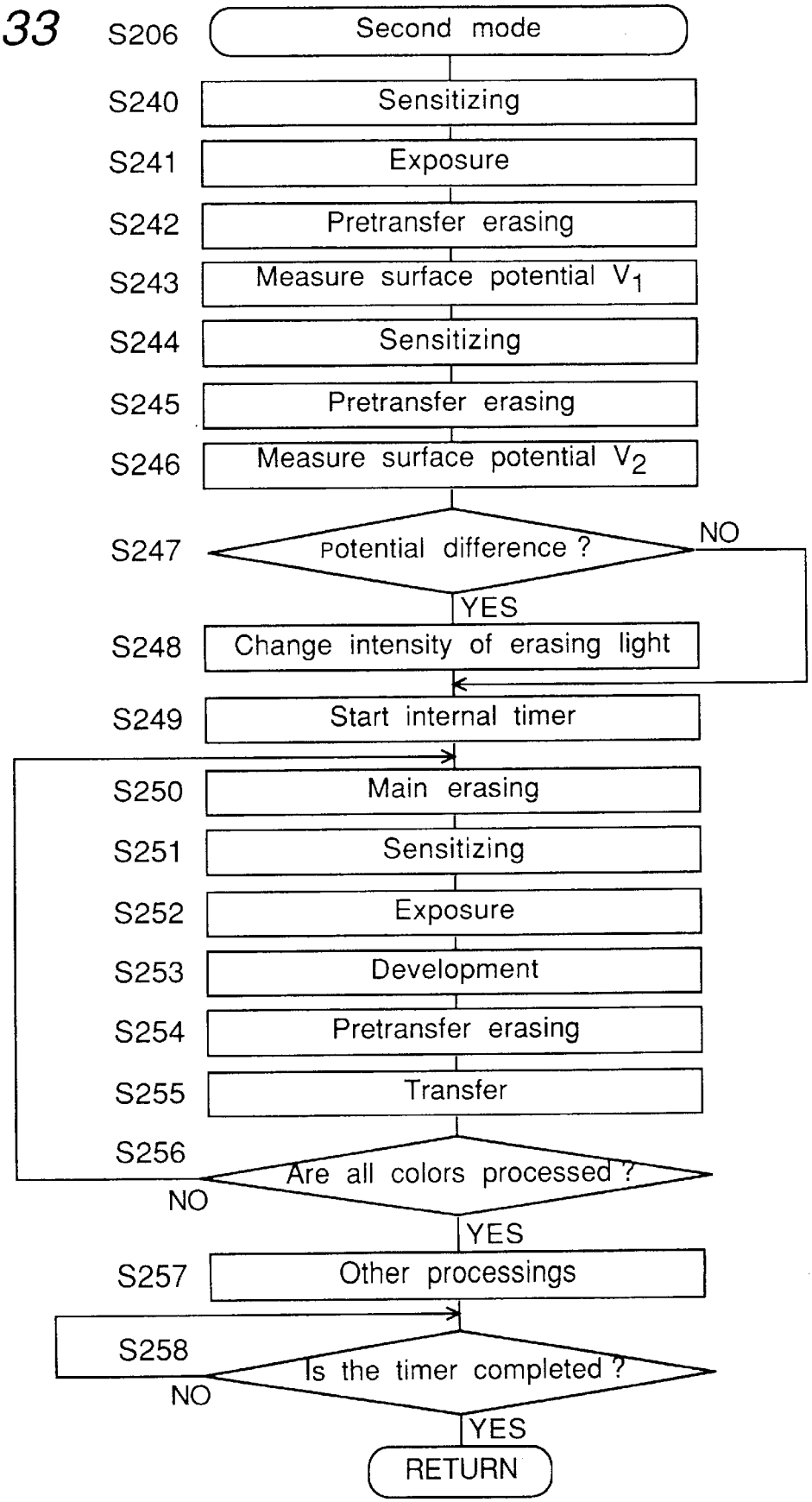
FIG. 33 is a flowchart of second mode processing.

FIG. 33 shows the flow of the second mode processing (step S206 in FIG. 28). First, the photoconductor 1001 is uniformly charged with a predetermined grid electric potential $V_G$ (step S240). Next, the laser diode 1102 is made to emit a light of a predetermined intensity to expose the photoconductor 1001 (step S241). Next, the pretransfer eraser 1017 is made to emit a light at the optical intensity for pretransfer erasing (step S242). Next, the surface electric potential $V_1$ of the photoconductor 1001 is measured with the electric potential sensor 1020 (step S243). The photoconductor 1001 is uniformly charged again at the predetermined grid electric potential $V_G$ (step S244). At this time, the laser diode 1102 does not emit light, while the pretransfer eraser 1017 is made to emit a light at the optical intensity for pretransfer erasing (step S245). Then, the surface electric potential $V_2$ of the photoconductor 1001 is measured with the electric potential sensor 1020 (step S246). If the difference between the two values $V_1$ and $V_2$ obtained last time has changed (YES at step S247), the intensity of light emission of the pretransfer eraser 1017 is corrected appropriately according to the difference (step S248). The difference in the developing point is also taken into account. Specifically, the intensity of light emission of the pretransfer eraser 1017 is set according to Table 3. On the other hand, if the difference is the same (NO at step S247), the intensity of light emission of pretransfer erasing is not changed. Next, an internal timer is started (step S249).

TABLE 3

| Intensity of pretransfer erasing | |
|---|---|
| \|NGV\|−\|GV\| (V) | Quantity of erasing light (mW/cm$^2$) |
| 0–20 | 0.56 |
| 21–40 | 0.58 |
| 41–60 | 0.60 |
| 61–80 | 0.63 |
| 81–100 | 0.67 |
| 101–120 | 0.72 |

Next, the surface of the photoconductor 1001 is discharged with the main eraser 1019 (step S250). Then, the sensitizing charger 1003 is driven to sensitize the photoconductor 1001 uniformly with the predetermined grid electric potential $V_G$ (step S251). Next, the laser diode 1102 emits light based on the image data of a document to expose the photoconductor 1001 to form an electrostatic latent image on the photoconductor 1001 (step S252). Then, a predetermined developing device is selected to develop the electrostatic latent image with toners to form a toner image (step S253). The developing device is selected in the order of the developing devices 1005C', 1005Y', 1005M' and 1005BK' for cyan, magenta, yellow and black. Next, the pretransfer erasing is performed with the predetermined intensity of light emission (step S254). The toner image is transferred onto the paper supplied from the paper supply cassette 50 (step S255). The flow returns to step S250 if all of the four colors of cyan, magenta, yellow and black are not printed (NO at step S256). If all the four colors are printed (YES at step S256), other processings such as removal of residual toners on the photoconductor 1001 are performed (step S257). Then, after the internal timer is counted up (YES at step S258), the flow returns to the main routine.

In the above-mentioned embodiment, the amount of discharging with the pretransfer eraser can be set appropriately when the amount of charging by the sensitizing charger is changed. Therefore, an excellent image without noises is obtained. Moreover, the amount of discharging with the pretransfer eraser can be set appropriately when the surface potential of the photoconductor is changed. Therefore, an excellent image without noises is obtained. Moreover, the amount of discharging by the pretransfer eraser is changed according to the position of the developing device. Therefore, an excellent image without the noise is obtained.

In the above-mentioned embodiments, the digital full color copying machine is explained. However, this invention can be applied to other image forming apparatuses such as for example an analog copying machine and a microreader printer.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image forming apparatus comprising:

a photoconductor;

a latent image forming device for forming a latent image on said photoconductor according to image data of a document;

a developing device for forming a toner image on the latent image;

a transfer device for transferring the toner image formed on said photoconductor onto a transfer material;

a first decision means for deciding a first image attribute data of whether image data comprises bi-level data or multi-level data; and a controller which controls transfer pressure of said transfer device according to the first image attribute data obtained by said first decision means.

2. The apparatus according to claim 1, wherein said transfer device comprises a transfer brush supplying charges to a transfer material, and said controller controls transfer pressure of said transfer brush against the transfer material.

3. The apparatus according to claim 2, wherein said controller sets the transfer pressure larger than a counterpart set for bi-level image data if said first decision means decides that the image data comprises multi-level image data.

4. The apparatus according to claim 2, wherein said controller controls transfer current supplied to said transfer brush.

5. The apparatus according to claim 4, wherein said controller sets the transfer current smaller than a counterpart set for bi-level image data if said first decision means decides that the image data comprises multi-level image data.

6. The apparatus according to claim 1, further comprising an eraser which removes excess charges on said photoconductor, by emitting light before the toner image formed on said photoconductor is transferred onto the transfer material, wherein said controller controls an intensity of light emitted by said eraser.

7. The apparatus according to claim 4, wherein said controller sets the intensity of light emitted by said eraser larger than a counterpart for bi-level image data if said first decision means decides that the image data comprises multi-level image data.

8. The apparatus according to claim 1, wherein said first decision means decides the first image attribute in each of a plurality of areas in the image data.

9. The apparatus according to claim 1, further comprising a second decision means for deciding whether or not a second image attribute of image data comprises dot image data, wherein said controller controls transfer pressure according to the first and second image attributes obtained by said first and second decision means.

10. The apparatus according to claim 9, wherein said transfer device comprises a transfer brush supplying charges to the transfer material, and said controller controls transfer pressure of said transfer brush against the transfer material.

11. The apparatus according to claim 10, wherein said controller sets the transfer pressure larger than a counterpart set for bi-level image data if said first decision means decides that the image data comprises multi-level image data or dot image data.

12. The apparatus according to claim 10, wherein said controller controls transfer current supplied to said transfer brush.

13. The apparatus according to claim 12, wherein said controller sets the transfer current smaller than a counterpart set for bi-level image data if said first decision means decides that the image data comprises multi-level image data or dot image data.

14. The apparatus according to claim 9, further comprising an eraser which removes excess charges on said photoconductor before the image formed on said photoconductor is transferred onto the transfer material, wherein said controller controls an intensity of light emitted by said eraser.

15. The apparatus according to claim 14, wherein said controller sets the intensity of said eraser at a value larger than a counterpart for bi-level image data if said first decision means decides that the image data comprises multi-level image data or dot image data.

16. The apparatus according to claim 9, wherein said first and second decision means decide the first and second image attributes in each of a plurality of areas in the image data.

17. An image forming apparatus comprising:

a photoconductor;

a latent image forming device for forming a latent image on said photoconductor according to image data of a document;

a developing device for forming a toner image on the latent image;

a transfer device for transferring the toner image formed on said photoconductor onto a transfer material;

a decision means for deciding an image attribute data of whether or not image data are dot image data; and a controller which controls transfer pressure of said transfer device according to the image attribute obtained by said decision means.

18. The apparatus according to claim 17, wherein said transfer device comprises a transfer brush supplying charges to a transfer material, and said controller controls transfer pressure of said transfer brush against the transfer material.

19. The apparatus according to claim 18, wherein said controller increase the transfer pressure if the image data comprises dot image data.

20. The apparatus according to claim 18, wherein said controller controls transfer current supplied to said transfer brush.

21. The apparatus according to claim 20, wherein said controller decrease the transfer current if the image data comprises dot image data.

22. The apparatus according to claim 17, further comprising an eraser which removes excess charges on said photoconductor before the image formed on said photoconductor is transferred onto the transfer material, wherein said controller controls an intensity of light emitted by said eraser.

23. The apparatus according to claim 22, wherein said controller increases the intensity of light emitted by said eraser if the image data comprises dot image data.

24. An image forming apparatus comprising:

a photoconductor;

an exposure device for forming an electrostatic latent image on said photoconductor according to image data;

a developing device for forming a toner image on the latent image;

a transfer device for transferring the toner image onto a transfer material;

an eraser which removes charges from the surface of said photoconductor;

a selection device for selecting an exposure gradation method to be used by said exposure device among bi-level exposure gradation method and multi-level gradation method; and a controller which sets a degree of removal of charges by said eraser according to the exposure gradation method selected by said selection device.

25. The apparatus according to claim 24 wherein when the bi-level exposure, gradation method is selected by said selection device said controller sets the degree of the removal of charges larger than that for the multi-level exposure gradation method.

26. An image forming apparatus comprising:

a photoconductor;

an exposure device for forming an electrostatic latent image on said photoconductor according to image data;

a developing device for forming a toner image on the latent image;

a transfer device for transferring the toner image onto a transfer material;

an eraser for removing charges from said photoconductor;

a selection device for selecting a mode which enhances a difference in density of the image data; and a controller which sets a degree of removal of charges by said eraser according to whether or not the mode is set by said selection device.

27. The apparatus according to claim 26 wherein when the mode is selected by said selection device, said controller sets the degree of the removal of charges so that a difference between the potential of an image area and that of a non-image area is in a predetermined range and that the potential of the non-image area is larger than that of the image area.

28. An image forming apparatus comprising:

a photoconductor;

a sensitizing charger for sensitizing said photoconductor with a grid potential;

an exposure device for forming an electrostatic latent image on said photoconductor according to image data;

a developing device for forming a toner image on the latent image;

a transfer device for transferring the toner image onto a transfer material;

an eraser provided for removing charges from said photoconductor;

a controller which sets a suitable grid potential of said sensitizing charger and further sets a degree of the removal of charges by said eraser corresponding to the set grid potential.

29. The apparatus according to claim 28 further comprising a sensor for detecting a property related to a photosensitive characteristics of said photoconductor so that said controller sets the grid potential based on said property.

30. The apparatus according to claim 29, wherein said sensor comprises a sensor which detects a density of a toner image formed on said photoconductor in predetermined conditions.

31. An image forming apparatus comprising:

a photoconductor;

a sensitizing charger for sensitizing said photoconductor;

an exposure means for forming an electrostatic latent image on said photoconductor according to image data;

a developing device for forming a toner image on the latent image;

a transfer device for transferring the toner image onto a transfer material;

an eraser for removing charges from said photoconductor;

a potential sensor which detects a potential of the surface of said photoconductor after removing charges therefrom by said eraser; and a controller which sets a degree of the removal of charges by said eraser according to the potential detected by said potential sensor.

32. An image forming apparatus comprising:

a photoconductor;

a sensitizing charger for sensitizing said photoconductor;

an exposure means for forming an electrostatic latent image on said photoconductor according to image data;

a plurality of developing devices for forming a toner image on the latent image, said plurality of developing devices being arranged successively along a rotational direction of said photoconductor;

a transfer device for transferring the toner image onto a transfer material;

an eraser provided for removing charges from said photoconductor; and a controller which activates one of said plurality of developing devices for development and sets a degree of the removal of charges by said eraser in accordance with which one is activated among said plurality of developing devices.

33. The apparatus according to claim 32, wherein said controller decreases the degree of the removal of charges by said eraser according as a distance between said one developing device activated and said transfer device decreases.

34. An image forming apparatus comprising:

a photoconductive member;

a latent image forming device for forming a latent image on said photoconductive member according to image data of a document;

a developing device for developing the latent image;

a transfer device for transferring the toner image onto a transfer material;

an eraser for discharging the surface of the photoconductive member developed by the developing device; and a controller for setting the amount of discharge of said eraser in accordance with a type of the document image, wherein when the document includes portions of different image types, said controller separately sets the discharge amount of said eraser for each portion.

* * * * *